US011375309B2

(12) United States Patent
Hirose et al.

(10) Patent No.: US 11,375,309 B2
(45) Date of Patent: Jun. 28, 2022

(54) SOUND COLLECTION DEVICE, SOUND COLLECTION METHOD, AND PROGRAM

(71) Applicant: Panasonic Intellectual Property Management Co., Ltd., Osaka (JP)

(72) Inventors: Yoshifumi Hirose, Kyoto (JP); Yusuke Adachi, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/116,192

(22) Filed: Dec. 9, 2020

(65) Prior Publication Data

US 2021/0120333 A1 Apr. 22, 2021

Related U.S. Application Data

(63) Continuation of application No. PCT/JP2019/011503, filed on Mar. 19, 2019.

(30) Foreign Application Priority Data

Jun. 12, 2018 (JP) ..... JP2018-112160

(51) Int. Cl.
*H04R 1/40* (2006.01)

(52) U.S. Cl.
CPC ..... *H04R 1/406* (2013.01)

(58) Field of Classification Search
None
See application file for complete search history.

(56) References Cited

U.S. PATENT DOCUMENTS

2012/0249785 A1 10/2012 Sudo et al.
2013/0246270 A1* 9/2013 Du ..... G06F 3/167 705/44
2015/0365759 A1* 12/2015 Dimitriadis ..... G06K 9/00684 381/71.1
2018/0176680 A1* 6/2018 Knight ..... H04R 1/406

FOREIGN PATENT DOCUMENTS

JP 2006-039267 2/2006
JP 2012-216998 11/2012

OTHER PUBLICATIONS

English translation of International Preliminary Report on Patentability dated Dec. 24, 2020 in International Application No. PCT/JP2019/011503.

* cited by examiner

*Primary Examiner* — James K Mooney
(74) *Attorney, Agent, or Firm* — Wenderoth, Lind & Ponack, L.L.P.

(57) ABSTRACT

The present disclosure provides a sound collection device that collects a sound while suppressing noise. The sound collection device includes: a storage that stores first data indicating a feature amount of an image of an object indicating a noise source or a target sound source; and a control circuit that specifies a direction of the noise source by performing a first collation of collating image data generated by a camera with the first data, and performs signal processing on an acoustic signal outputted from a microphone array so as to suppress a sound arriving from the specified direction of the noise source.

15 Claims, 18 Drawing Sheets

SOUND COLLECTION DEVICE, SOUND COLLECTION METHOD, AND PROGRAM

CROSS REFERENCE TO RELATED APPLICATION(S)

This is a continuation application of International Application No. PCT/JP2019/011503, with an international filling date of Mar. 19, 2019, which claims priority of Japanese Patent Application No. 2018-112160 filed on Jun. 12, 2018, each of the content of which is incorporated herein by reference.

BACKGROUND

1. Technical Field

The present disclosure relates to a sound collection device, a sound collection method, and a program for collecting a target sound.

2. Related Art

JP 2012-216998 A discloses a signal processing device that performs noise reduction processing on sound collection signals obtained from a plurality of microphones. This signal processing device detects a speaker based on imaged data of a camera, and specifies a relative direction of the speaker with respect to a plurality of speakers. Moreover, this signal processing device specifies a direction of a noise source from a noise level included in an amplitude spectrum of a sound collection signal. The signal processing device performs noise reduction processing when the relative direction of the speaker and the direction of the noise source match. This effectively reduces a disturbance signal.

SUMMARY

The present disclosure provides a sound collection device, a sound collection method, and a program that improve the accuracy of collecting a target sound.

According to one aspect of the present disclosure, there is provided a sound collection device that collects a sound while suppressing noise, the sound collection device including: a storage that stores first data indicating a feature amount of an image of an object that indicates a noise source or a target sound source; and a control circuit that specifies a direction of the noise source by performing a first collation of collating image data generated by a camera with the first data, and performs signal processing on an acoustic signal outputted from a microphone array so as to suppress a sound arriving from the specified direction of the noise source.

These general and specific aspects may be implemented by systems, methods, and computer programs, and combinations thereof.

According to the sound collection device, the sound collection method, and the program of the present disclosure, the direction in which the sound is suppressed is determined by collating the image data obtained from the camera with the feature amount of the image of the object that indicates the noise source or the target sound source. Therefore, the noise can be accurately suppressed. This improves the accuracy of collecting the target sound.

DETAILED DESCRIPTION (Findings that Form the Basis of Present Disclosure)

The signal processing device of JP 2012-216998 A specifies the direction of the noise source from the noise level included in the amplitude spectrum of the sound collection signal. However, it is difficult to accurately specify the direction of the noise source only by the noise level. A sound collection device of the present disclosure collates at least any one of image data acquired from a camera and an acoustic signal acquired from a microphone array with data indicating a feature amount of a noise source or a target sound source to specify a direction of the noise source. As a result, the direction of the noise source can be accurately specified, and the noise arriving from the specified direction can be suppressed by signal processing. By accurately suppressing the noise, the accuracy of collecting the target sound is improved.

First Embodiment

Hereinafter, embodiments will be described with reference to the drawings. In the present embodiment, an example in which a human voice is collected as a target sound will be described.

1. Configuration of Sound Collection Device

Figure 1:
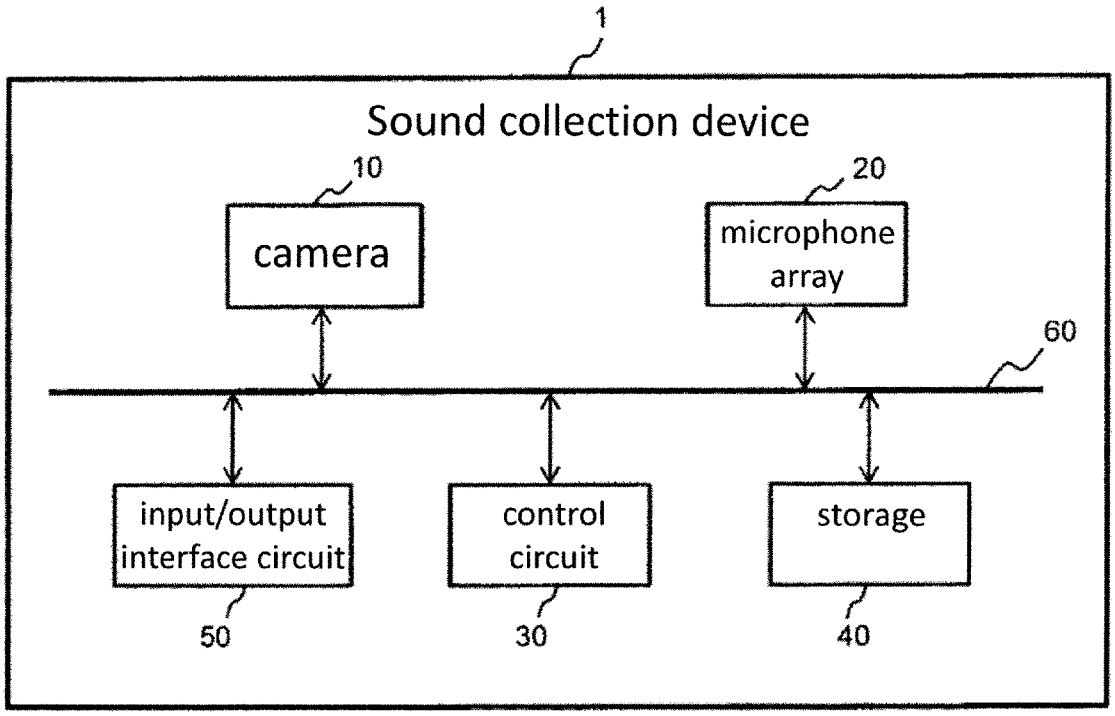
FIG. 1 is a block diagram showing a configuration of a sound collection device of a first embodiment.

FIG. 1 shows a configuration of a sound collection device of the present disclosure. A sound collection device 1 includes a camera 10, a microphone array 20, a control circuit 30, a storage 40, an input/output interface circuit 50, and a bus 60. The sound collection device 1 collects a human voice in a meeting, for example. In the present embodiment, the sound collection device 1 is a dedicated sound collection device in which the camera 10, the microphone array 20, the control circuit 30, the storage 40, the input/output interface circuit 50, and the bus 60 are integrated.

The camera 10 includes an image sensor such as a CCD image sensor, a CMOS image sensor, or an NMOS image sensor. The camera 10 generates and outputs image data which is an image signal.

The microphone array 20 includes a plurality of microphones. The microphone array 20 receives a sound wave, converts it into an acoustic signal which is an electric signal, and outputs the acoustic signal.

The control circuit 30 estimates a target sound source direction and a noise source direction based on the image data obtained from the camera 10 and the acoustic signal obtained from the microphone array 20. The target sound source direction is a direction in which a target sound source that emits a target sound is present. The noise source direction is a direction in which a noise source that emits noise is present. The control circuit 30 fetches the target sound from the acoustic signal output from the microphone array 20 by performing signal processing so as to emphasize the sound arriving from the target sound source direction and suppress the sound arriving from the noise source direction. The control circuit 30 can be implemented by a semiconductor element or the like. The control circuit 30 can be configured by, for example, a microcomputer, CPU, MPU, DSP, FPGA, or ASIC.

The storage 40 stores noise source data indicating a feature amount of the noise source. The image data obtained from the camera 10 and the acoustic signal obtained from the microphone array 20 may be stored in the storage 40. The storage 40 can be implemented by, for example, a hard disk (HDD), SSD, RAM, DRAM, a ferroelectric memory, a flash memory, a magnetic disk, or a combination thereof.

The input/output interface circuit 50 includes a circuit that communicates with an external device according to a predetermined communication standard. The predetermined communication standard includes, for example, LAN, Wi-Fi®, Bluetooth®, USB, and HDMI®.

The bus 60 is a signal line that electrically connects the camera 10, the microphone array 20, the control circuit 30, the storage 40, and the input/output interface circuit 50.

When the control circuit 30 acquires image data from the camera 10 or fetches it from the storage 40, the control circuit 30 corresponds to an input device for the image data. When the control circuit 30 acquires the acoustic signal from the microphone array 20 or fetches it from the storage 40, the control circuit 30 corresponds to an input device of the acoustic signal.

Figure 2:
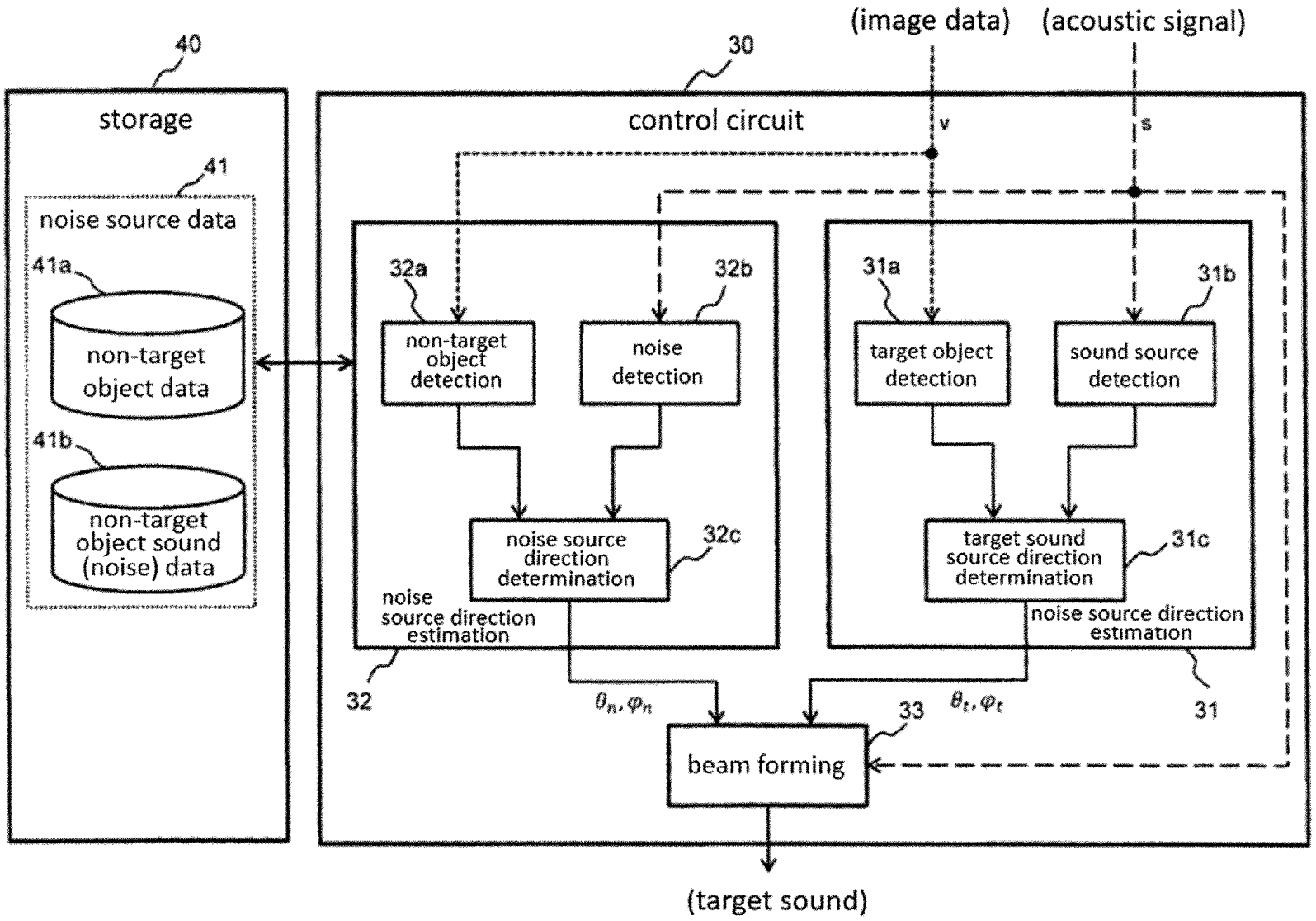
FIG. 2 is a block diagram showing an example of functions of a control circuit and data in a storage according to the first embodiment.

FIG. 2 shows functions of the control circuit 30 and data stored in the storage 40. The functions of the control circuit 30 may be configured only by hardware, or may be implemented by combining hardware and software.

The control circuit 30 performs, as its function, a target sound source direction estimation operation 31, a noise source direction estimation operation 32, and a beam forming operation 33.

The target sound source direction estimation operation 31 estimates the target sound source direction. The target sound source direction estimation operation 31 includes a target object detection operation 31*a*, a sound source detection operation 31*b*, and a target sound source direction determination operation 31*c*.

The target object detection operation 31*a* detects a target from image data v generated by the camera 10. The target object is an object that is a target sound source. The target object detection operation 31*a* detects, for example, a human face as a target object. Specifically, the target object detection operation 31*a* calculates a probability $P(\theta_t, \varphi_t|v)$ that a target object is included in each image in a plurality of determination regions $r(\theta_t, \varphi_t)$ in the image data v, wherein the image data v corresponds to one frame of a video or one still image. The determination regions $r(\theta_t, \varphi_t)$ will be described later.

The sound source detection operation 31*b* detects a sound source from an acoustic signal s obtained from the microphone array 20. Specifically, the sound source detection operation 31*b* calculates a probability $P(\theta_t, \varphi_t|s)$ that the sound source is present in a direction specified by a horizontal angle $\theta_t$ and a vertical angle $\varphi_t$ with respect to the sound collection device 1.

The target sound source direction determination operation 31*c* determines the target sound source direction based on the probability $P(\theta_t, \varphi_t|v)$ that the image is the target object and the probability $P(\theta_t, \varphi_t|s)$ of the presence of the sound source. The target sound source direction is indicated by, for example, the horizontal angle $\theta_t$ and the vertical angle $\varphi_t$ with respect to the sound collection device 1.

The noise source direction estimation operation 32 estimates the noise source direction. The noise source direction estimation operation 32 includes a non-target object detection operation 32*a*, a noise detection operation 32*b*, and a noise source direction determination operation 32*c*.

The non-target object detection operation 32*a* detects a non-target object from the image data v generated by the camera 10. Specifically, the non-target object detection operation 32*a* determines whether or not a non-target object is included in each image in a plurality of determination regions $r(\theta_n, \varphi_n)$ in the image data v, wherein the image data v corresponds to one frame of a video or one still image. The non-target object is an object that is a noise source. For example, when the sound collection device 1 is used in a conference room, the non-target objects are a door of the conference room, a projector in the conference room, and the like. For example, when the sound collection device 1 is used outdoors, the non-target object is a moving object that emits a sound, such as an ambulance.

The noise detection operation 32*b* detects noise from the acoustic signal s output by the microphone array 20. In the present specification, noise is also referred to as a non-target sound. Specifically, the noise detection operation 32*b* determines whether or not the sound arriving from the direction specified by a horizontal angle $\theta_n$ and a vertical angle $\varphi_n$ is noise. The noise is, for example, a sound of opening and closing a door, a sound of a fan of a projector, and a siren sound of an ambulance.

The noise source direction determination operation 32*c* determines the noise source direction based on the determination result of the non-target object detection operation 32*a* and the determination result of the noise detection operation 32*b*. For example, when the non-target object detection operation 32*a* detects a non-target object and the noise detection operation 32*b* detects noise, the noise source direction is determined based on the detected position or direction. The noise source direction is indicated by, for example, the horizontal angle $\theta_n$ and the vertical angle $\varphi_n$ with respect to the sound collection device 1.

The beam forming operation 33 fetches the target sound from the acoustic signal s by performing signal processing on the acoustic signal s output by the microphone array 20 so as to emphasize the sound arriving from the target sound source direction and suppress the sound arriving from the noise source direction. As a result, a clear voice with reduced noise can be collected.

The storage 40 stores noise source data 41 indicating the feature amount of the noise source. The noise source data 41 may include one noise source or a plurality of noise sources. For example, the noise source data 41 may include cars, doors, and projectors as noise sources. The noise source data 41 includes non-target object data 41*a* and noise data 41*b* which is non-target sound data.

The non-target object data 41*a* includes an image feature amount of the non-target object that is a noise source. The non-target object data 41*a* is, for example, a database including the image feature amount of the non-target object. The image feature amount is, for example, at least one of a wavelet feature amount, a Haar-like feature amount, a HOG (Histograms of Oriented Gradients) feature amount, an EOH (Edge of Oriented Histograms) feature amount, an Edgelet feature amount, a Joint Haar-like feature amount, a Joint HOG feature amount, a sparse feature amount, a Shapelet feature amount, and a co-occurrence probability feature amount. The non-target object detection operation 32*a* detects the non-target object by collating the feature amount fetched from the image data v with the non-target object data 41*a*, for example.

The noise data 41*b* includes an acoustic feature amount of noise output by the noise source. The noise data 41*b* is, for example, a database including the acoustic feature amount of noise. The acoustic feature amount is, for example, at least one of MFCC (Mel-Frequency Cepstral Coefficient) and i-vector. The noise detection operation 32*b* detects noise, for example, by collating a feature amount fetched from the acoustic signal s with the noise data 41*b*.

2. Operation of Sound Collection Device 2.1 Overview of Signal Processing

Figure 3:
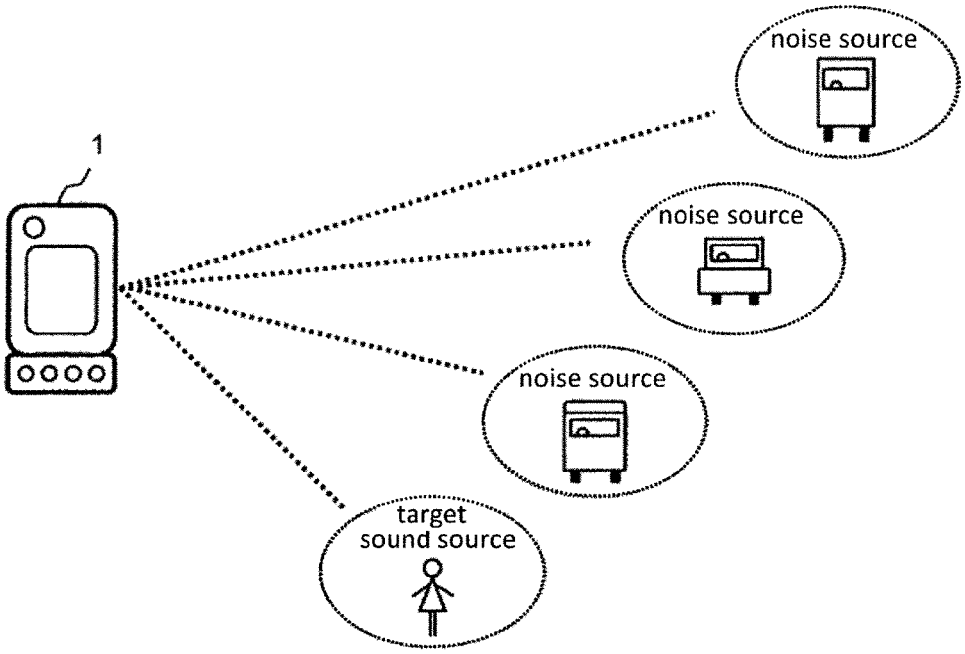
FIG. 3 is a diagram schematically showing an example of a sound collection environment.
Figure 4:
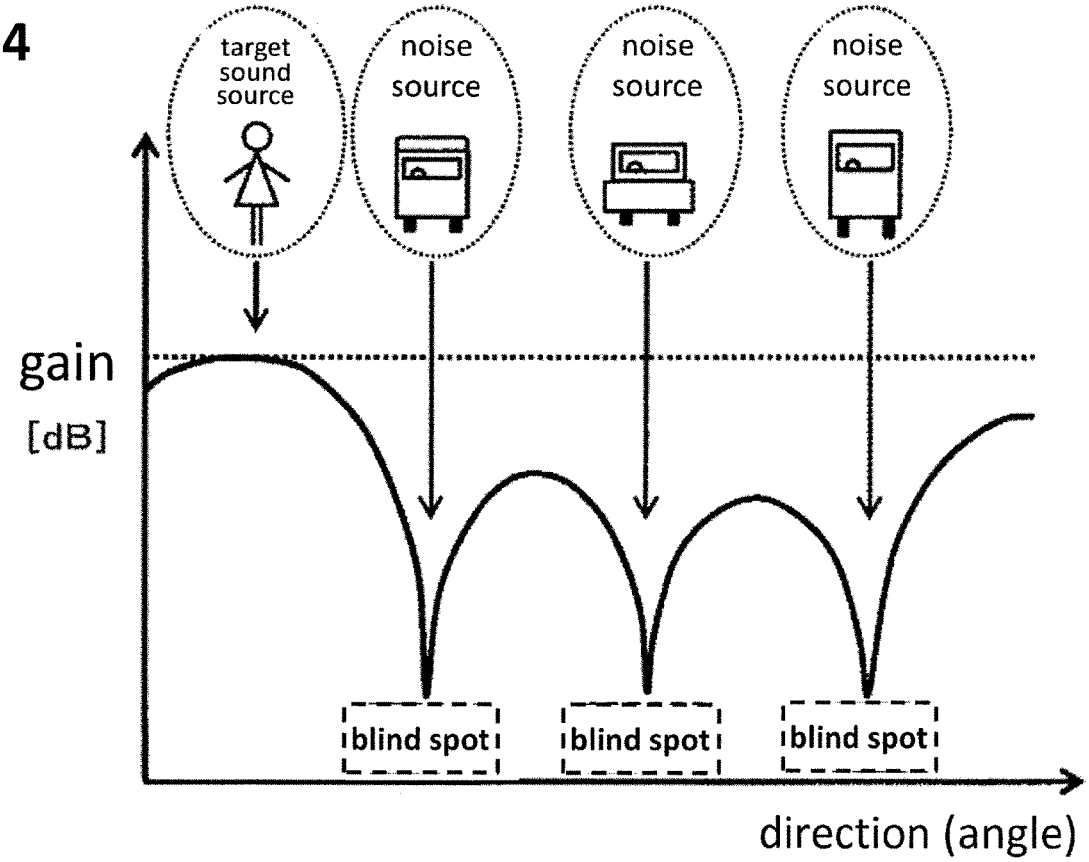
FIG. 4 is a diagram showing an example of emphasizing a sound from a target sound source and suppressing a sound from a noise source.

FIG. 3 schematically shows an example in which the sound collection device 1 collects a target sound emitted by a target sound source and noise emitted by a noise source around the sound collection device 1. FIG. 4 shows an example of signal processing for emphasizing a target sound and suppressing noise. The horizontal axis of FIG. 4 represents directions in which the target sound and the noise arrive, that is, angles of the target sound source and the noise source with respect to the sound collection device 1. The vertical axis of FIG. 4 represents a gain of the acoustic signal. As shown in FIG. 3, when there is a noise source around the sound collection device 1, the microphone array 20 outputs an acoustic signal containing noise. Therefore, the sound collection device 1 according to the present embodiment forms a blind spot by beam forming processing in the noise source direction, as shown in FIG. 4. That is, the sound collection device 1 performs signal processing on the acoustic signal so as to suppress the noise. As a result, the target sound can be collected accurately. The sound collection device 1 further performs signal processing on the acoustic signal so as to emphasize the sound arriving from the target sound source direction. As a result, the target sound can be collected further accurately.

2.2 Overall Operation of Sound Collection Device

Figure 5:
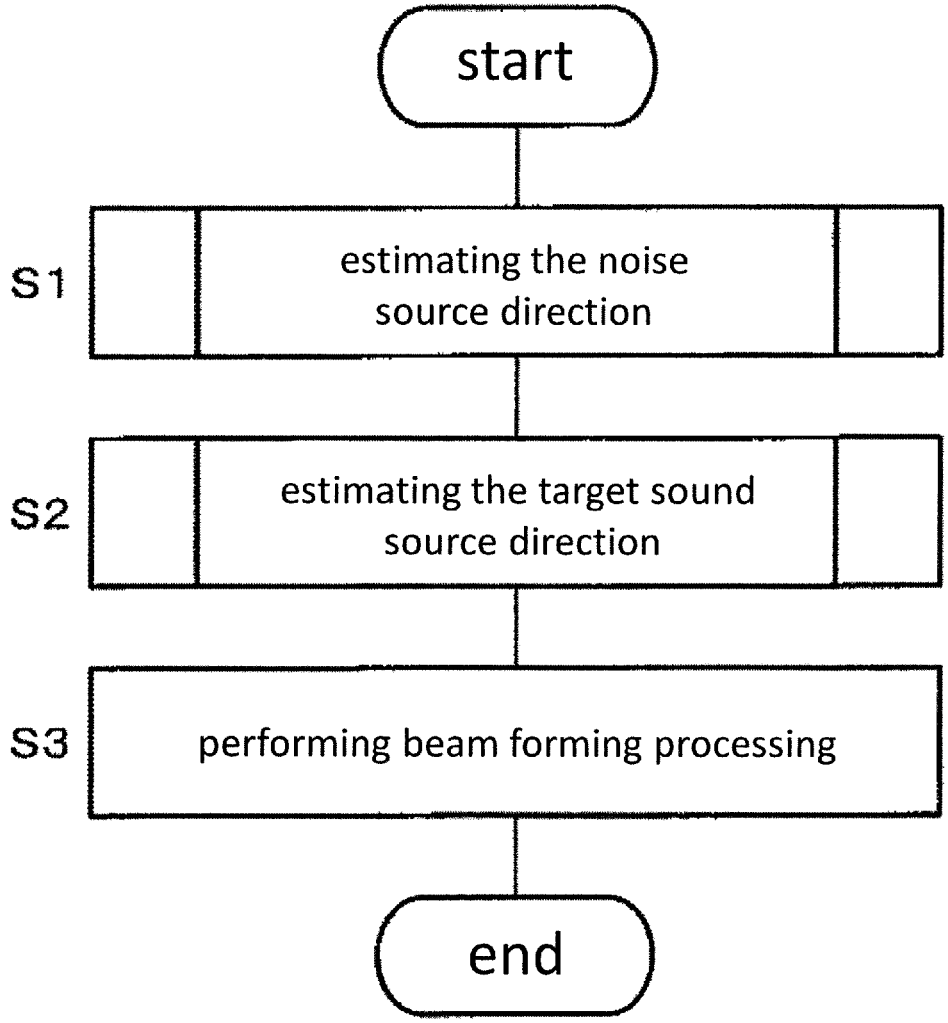
FIG. 5 is a flowchart showing a sound collection method according to the first to third embodiments.

FIG. 5 shows a sound collection operation by the control circuit 30.

The noise'source direction estimation operation 32 estimates the noise source direction (S1). The target sound source direction estimation operation 31 estimates the target sound source direction (S2). The beam forming operation 33 performs S11 beam forming processing based on the estimated noise source direction and the target sound source direction (S3). Specifically, the beam forming operation 33 performs signal processing on the acoustic signal output from the microphone array 20, so as to suppress the sound arriving from the noise source direction and emphasize the sound arriving from the target sound source direction. The order of the estimation of the noise source direction shown in Step 1 and the estimation of the target sound source direction shown in Step S2 may be reversed.

Figure 6A:
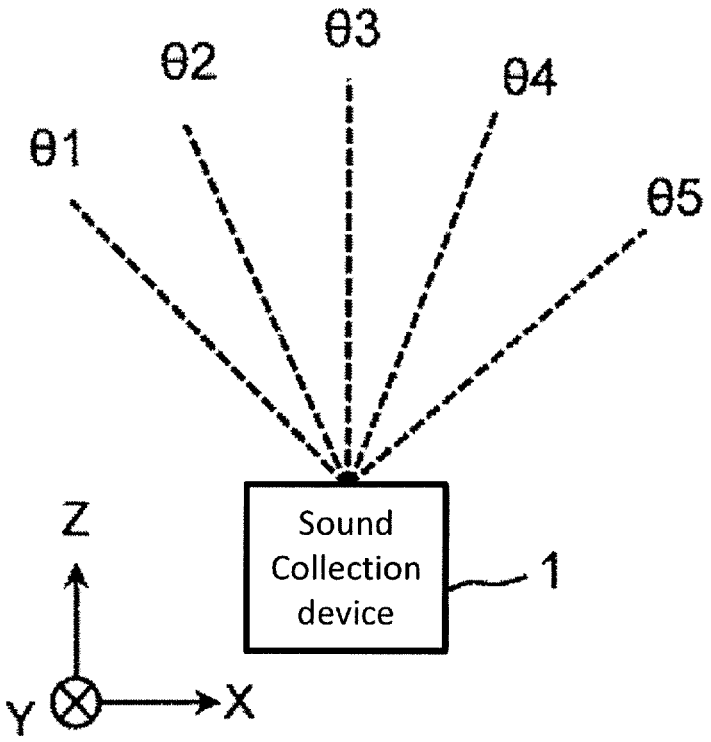
FIG. 6A is a diagram for explaining a sound collection direction at a horizontal angle.
Figure 6B:
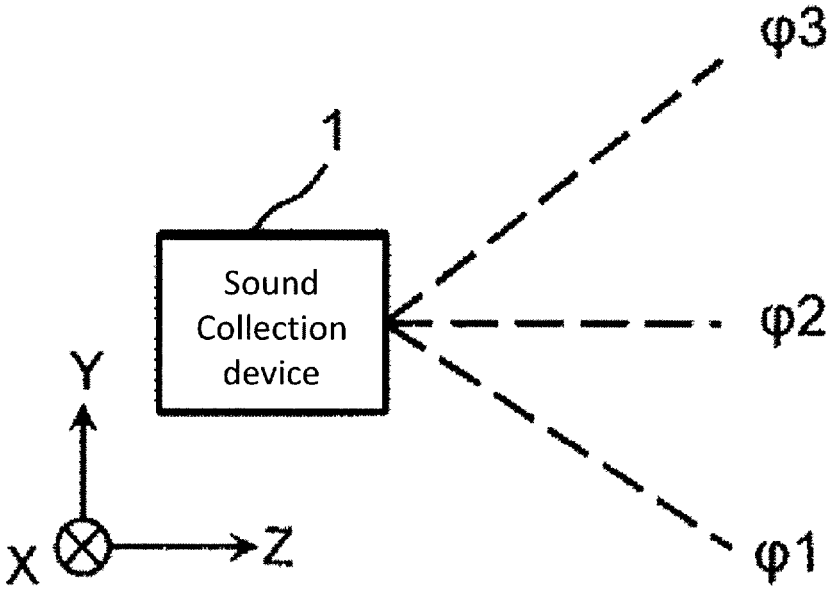
FIG. 6B is a diagram for explaining a sound collection direction at a vertical angle.
Figure 6C:
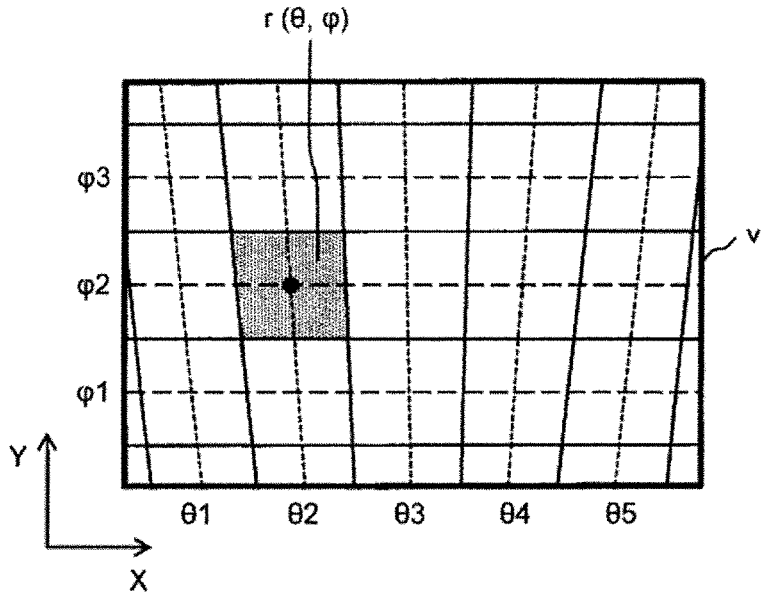
FIG. 6C is a diagram for explaining a determination region.

FIG. 6A schematically shows an example of collecting a sound at the horizontal angle θ. FIG. 6B schematically shows an example of collecting a sound at the vertical angle φ. FIG. 6C shows an example of the determination region r(θ, φ). The position of the coordinate system of each region in the image data v generated by the camera 10 is associated with the horizontal angle θ and the vertical angle φ with respect to the sound collection device 1 according to the angle of view of the camera 10. The image data v generated by the camera 10 can be divided into the plurality of determination regions r(θ, φ) according to the horizontal angle of view and the vertical angle of view of the camera 10. Note that the image data v may be divided into circumferential shapes or divided in a grid shape, depending on the type of the camera 10. In the present embodiment, it is determined in Step S1 whether or not the direction corresponding to the determination region r(θ, φ) is the noise source direction, and it is determined in Step S2 whether or not the direction corresponding to the determination region r(θ, φ) is the target sound source direction. In this specification, the determination region when the noise source direction is estimated (S1) is described as $r(\theta_n, \varphi_n)$, and the determination region when the target sound source direction is estimated (S2) is described as $r(\theta_t, \varphi_t)$. The size or shape of the determination regions $r(\theta_n, \varphi_n)$ and $r(\theta_t, \varphi_t)$ may be the same or different.

2.3 Estimation of Noise Source Direction

Figure 7:
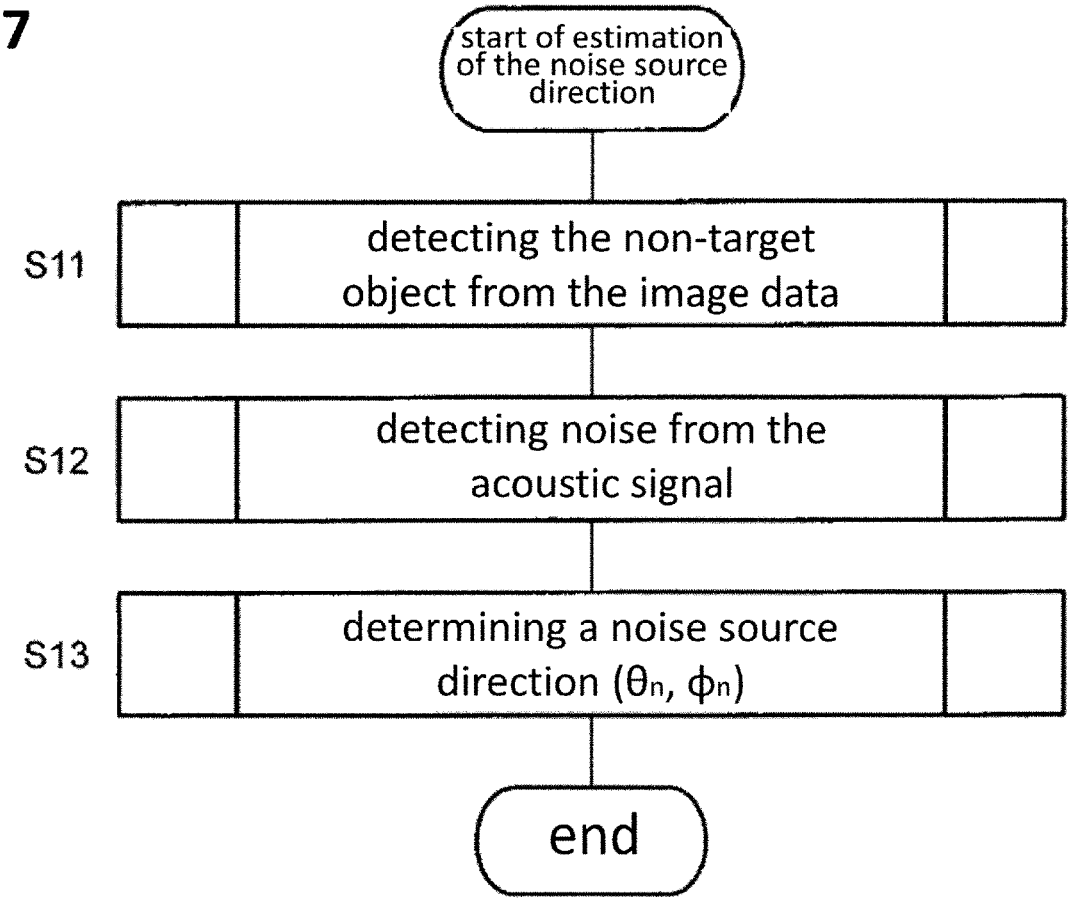
FIG. 7 is a flowchart showing an overall operation of estimating a noise source direction according to the first to third embodiments.

The estimation of the noise source direction will be described with reference to FIGS. 7 to 11. FIG. 7 shows the details of the estimation of the noise source direction (S1). In FIG. 7, the order of detection of a non-target object shown in Step S11 and detection of noise shown in Step S12 may be reversed.

The non-target object detection operation 32*a* detects the non-target object from the image data v generated by the camera 10 (S11). Specifically, the non-target object detection operation 32*a* determines whether or not the image in the determination region $r(\theta_n, \varphi_n)$ is the non-target in the image data v. The noise detection operation 32*b* detects noise from the acoustic signal s output from the microphone array 20 (S12). Specifically, the noise detection operation 32*b* determines, from the acoustic signal s, whether or not the sound arriving from the direction of the horizontal angle $\theta_n$ and the vertical angle $\varphi_n$ is noise. The noise source direction determination operation 32*c* determines a noise source direction ($\theta_n$, $\varphi_n$) based on the detection result of the non-target object and the noise (S13).

Figure 8:
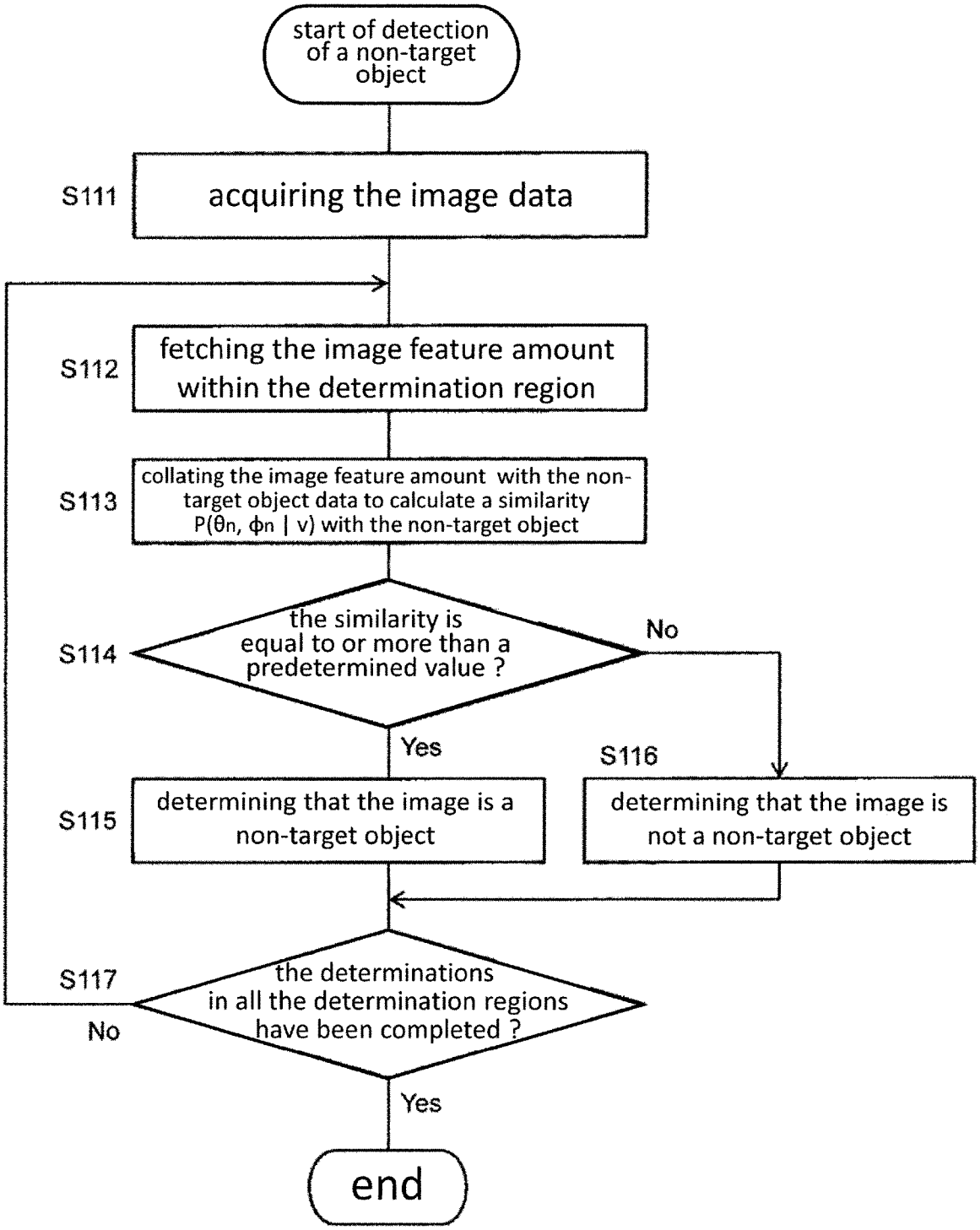
FIG. 8 is a flowchart showing detection of a non-target object according to the first embodiment.

FIG. 8 shows an example of detection of a non-target object (S11). The non-target object detection operation 32*a* acquires the image data v generated by the camera 10 (S111). The non-target object detection operation 32*a* fetches the image feature amount within the determination region r($\theta_n$, $\varphi_n$) (S112). The image feature amount to be fetched corresponds to the image feature amount indicated by the non-target object data 41*a*. For example, the image feature amount to be fetched is at least one of the wavelet feature amount, the Haar-like feature amount, the HOG feature amount, the EOH feature amount, the Edgelet feature amount, the Joint Haar-like feature amount, the Joint HOG feature amount, the sparse feature amount, the Shapelet feature amount, and the co-occurrence probability feature amount. The image feature amount is not limited to these and may be any feature amount for specifying an object from image data.

The non-target object detection operation 32*a* collates the fetched image feature amount with the non-target object data 41*a* to calculate a similarity P($\theta_n$, $\varphi_n$|v) with the non-target object (S113). The similarity P($\theta_n$, $\varphi_n$|v) is the probability that the image in the determination region r($\theta_n$, $\varphi_n$) is a non-target object, that is, the accuracy indicating likeness of a non-target object. The method of detecting a non-target object is freely selectable. For example, the non-target object detection operation 32*a* calculates the similarity by template matching between the fetched image feature amount and the non-target object data 41*a*.

The non-target object detection operation 32*a* determines whether or not the similarity is equal to or more than a predetermined value (S114). If the similarity is equal to or more than the predetermined value, it is determined that the image in the determination region r($\theta_n$, $\varphi_n$) is a non-target object (S115). If the similarity is lower than the predetermined value, it is determined that the image in the determination region r($\theta_n$, $\varphi_n$) is not a non-target object (S116).

The non-target object detection operation 32*a* determines whether or not the determinations in all the determination regions r($\theta_n$, $\varphi_n$) in the image data v have been completed (S117). If there is a determination region r($\theta_n$, $\varphi_n$) for which determination has not been made, the process returns to Step S112. When the determinations for all the determination regions r($\theta_n$, $\varphi_n$) are completed, the process shown in FIG. 8 is terminated.

Figure 9:
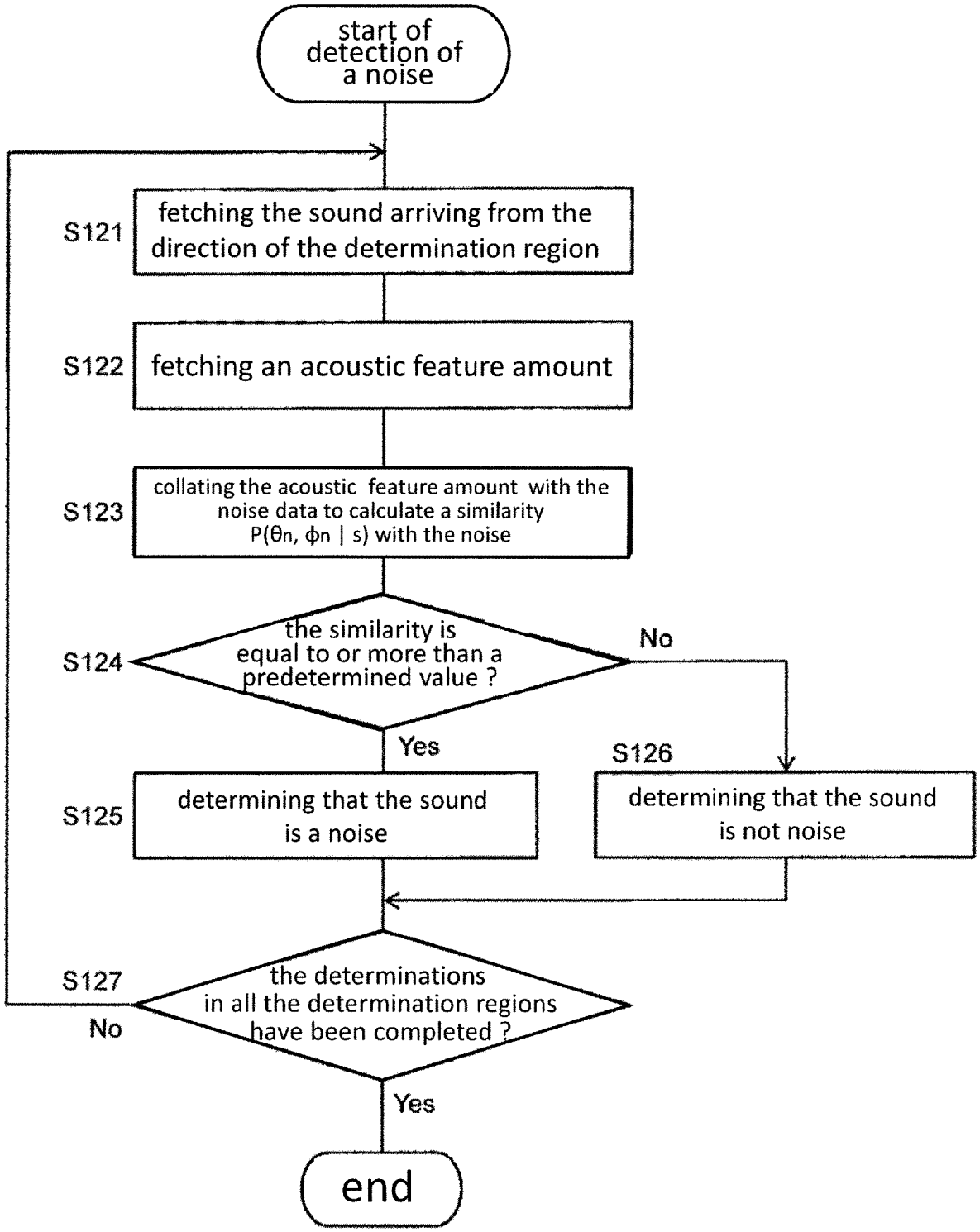
FIG. 9 is a flowchart showing detection of noise according to the first embodiment.

FIG. 9 shows an example of detection of noise (S12). The noise detection operation 32*b* forms directivity in the direction of the determination region r($\theta_n$, $\varphi_n$) and fetches the sound arriving from the direction of the determination region r($\theta_n$, $\varphi_n$) from the acoustic signal s (S121). The noise detection operation 32*b* fetches an acoustic feature amount from the fetched sound (S122). The acoustic feature amount to be fetched corresponds to the acoustic feature amount indicated by the noise data 41*b*. For example, the acoustic feature amount to be fetched is at least one of MFCC and i-vector. The acoustic feature amount is not limited to these and may be any feature amount for specifying an object from acoustic data.

The noise detection operation 32*b* collates the fetched acoustic feature amount with the noise data 41*b* to calculate a similarity P($\theta_n$, $\varphi_n$|s) with noise (S123). The similarity P($\theta_n$, $\varphi_n$|s) is the probability that the sound arriving from the direction of the determination region r($\theta_n$, $\varphi_n$) is noise, that is, the accuracy indicating likeness of noise. The method of detecting noise is freely selectable. For example, the noise detection operation 32*b* calculates the similarity by template matching between the fetched acoustic feature amount and the noise data 41*b*.

The noise detection operation 32*b* determines whether or not the similarity is equal to or more than a predetermined value (S124). If the similarity is equal to or more than the predetermined value, it is determined that the sound arriving from the direction of the determination region r($\theta_n$, $\varphi_n$) is noise (S125). If the similarity is lower than the predetermined value, it is determined that the sound arriving from the direction of the determination region r($\theta_n$, $\varphi_n$) is not noise (S126).

The noise detection operation 32*b* determines whether or not the determinations in all the determination regions r($\theta_n$, $\varphi_n$) have been completed (S127). If there is a determination region r($\theta_n$, $\varphi_n$) for which determination has not been made, the process returns to Step S121. When the determinations for all the determination regions r($\theta_n$, ($\varphi_n$) are completed, the process shown in FIG. 9 is terminated.

Figure 10:
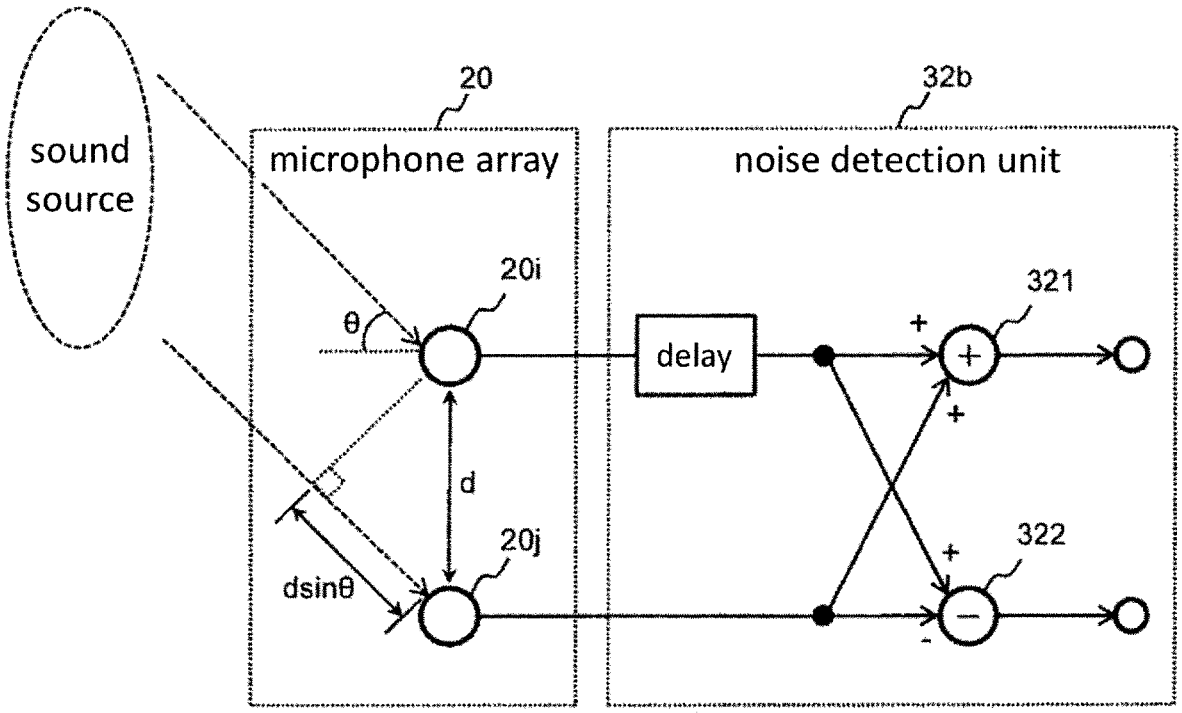
FIG. 10 is a diagram for explaining an example of an operation of a noise detection operation.

FIG. 10 shows an example of forming directivity in Step S121. FIG. 10 shows an example in which the microphone array 20 includes two microphones 20*i* and 20*j*. The reception timings of sound waves arriving from the θ direction in the microphones 20*i* and 20*j* differ depending on a distance d between the microphones 20*i* and 20*j*. Specifically, in the microphone 20*j*, a propagation delay corresponding to a distance dsine occurs. That is, a phase difference occurs in the acoustic signals output from the microphones 20*i* and 20*j*.

The noise detection operation 32*b* delays the output of the microphone 20*i* by a delay amount corresponding to the distance dsine, and then an adder 321 adds the acoustic signals output from the microphones 20*i* and 20*j*. At the input of the adder 321, the phases of the signals arriving from the θ direction match, and hence, at the output of the adder 321, the signals arriving from the θ direction are emphasized. On the other hand, signals arriving from directions other than θ do not have the same phase as each other, and thus are not emphasized as much as the signals arriving from θ. Therefore, for example, by using the output of the adder 321, directivity is formed in the θ direction.

In the example of FIG. 10, the direction at the horizontal angle θ is described as an example, but directivity can be similarly formed in the direction at the vertical angle φ.

Figure 11:
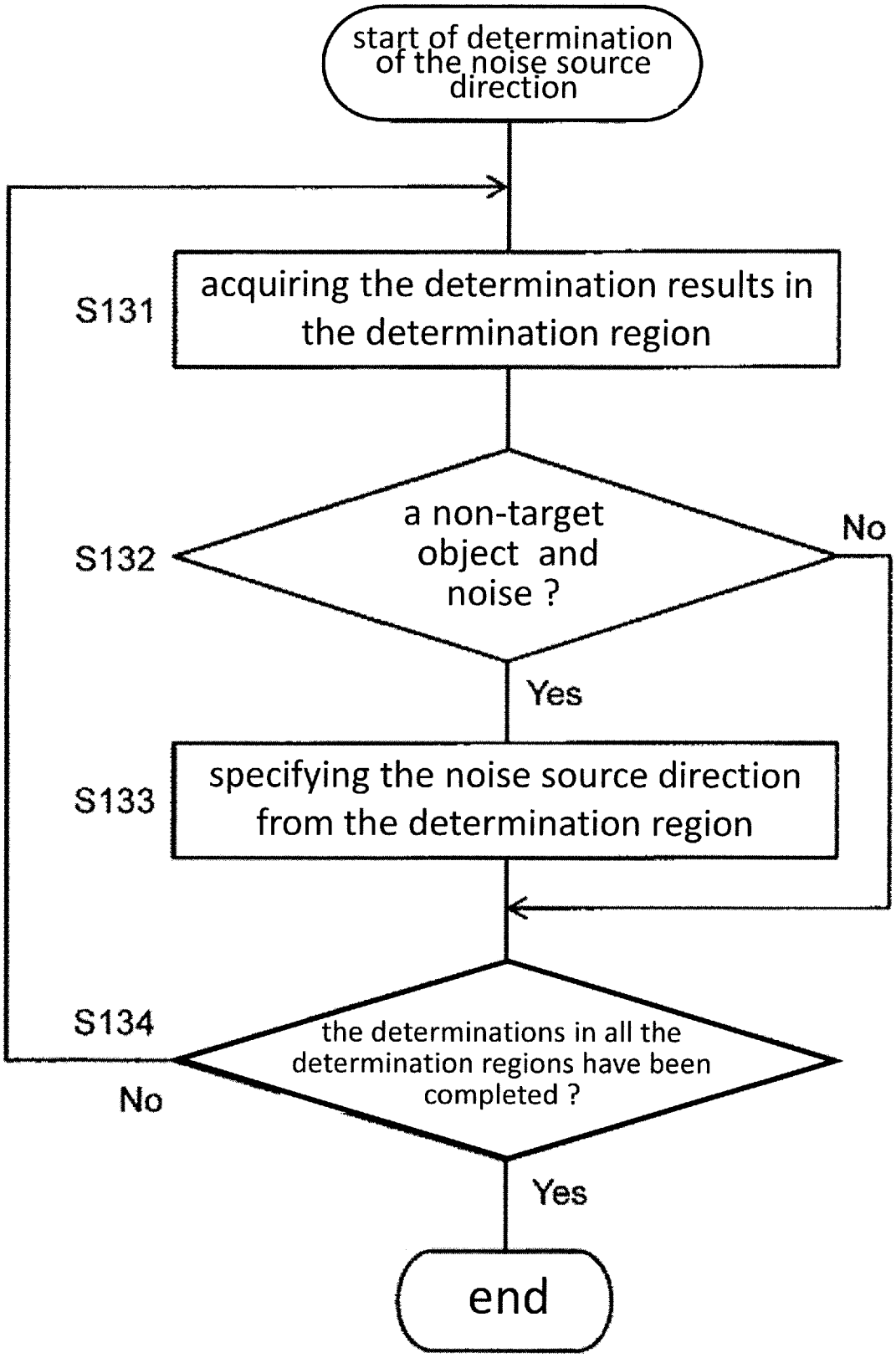
FIG. 11 is a flowchart showing determination of the noise source direction according to the first embodiment.

FIG. 11 shows an example of determination of the noise source direction (S13). The noise source direction determination operation 32*c* acquires the determination results in the determination region r($\theta_n$, $\varphi_n$) from the non-target object detection operation 32*a* and the noise detection operation 32*b* (S131). The noise source direction determination operation 32*c* determines whether or not the determination results in the determination region r($\theta_n$, $\varphi_n$) indicate that the image is a non-target object and noise (S132). If the determination results indicate that the image is a non-target object and noise, the noise source direction determination operation 32*c* determines that there is a noise source in the direction of the determination region r($\theta_n$, $\varphi_n$), and the horizontal angle $\theta_n$ and the vertical angle $\varphi_n$, which are the noise source direction, are specified from the determination region r($\theta_n$, $\varphi_n$) (S133).

The noise source direction determination operation 32*c* determines whether or not the determinations in all the determination regions r($\theta_n$, $\varphi_n$) have been completed (S134). If there is a determination region r($\theta_n$, $\varphi_n$) for which determination has not been made, the process returns to Step S131. When the determinations for all the determination regions $r(\theta_n, \varphi_n)$ are completed, the process shown in FIG. 11 is terminated.

2.4 Estimation of Target Sound Source Direction

Figure 12:
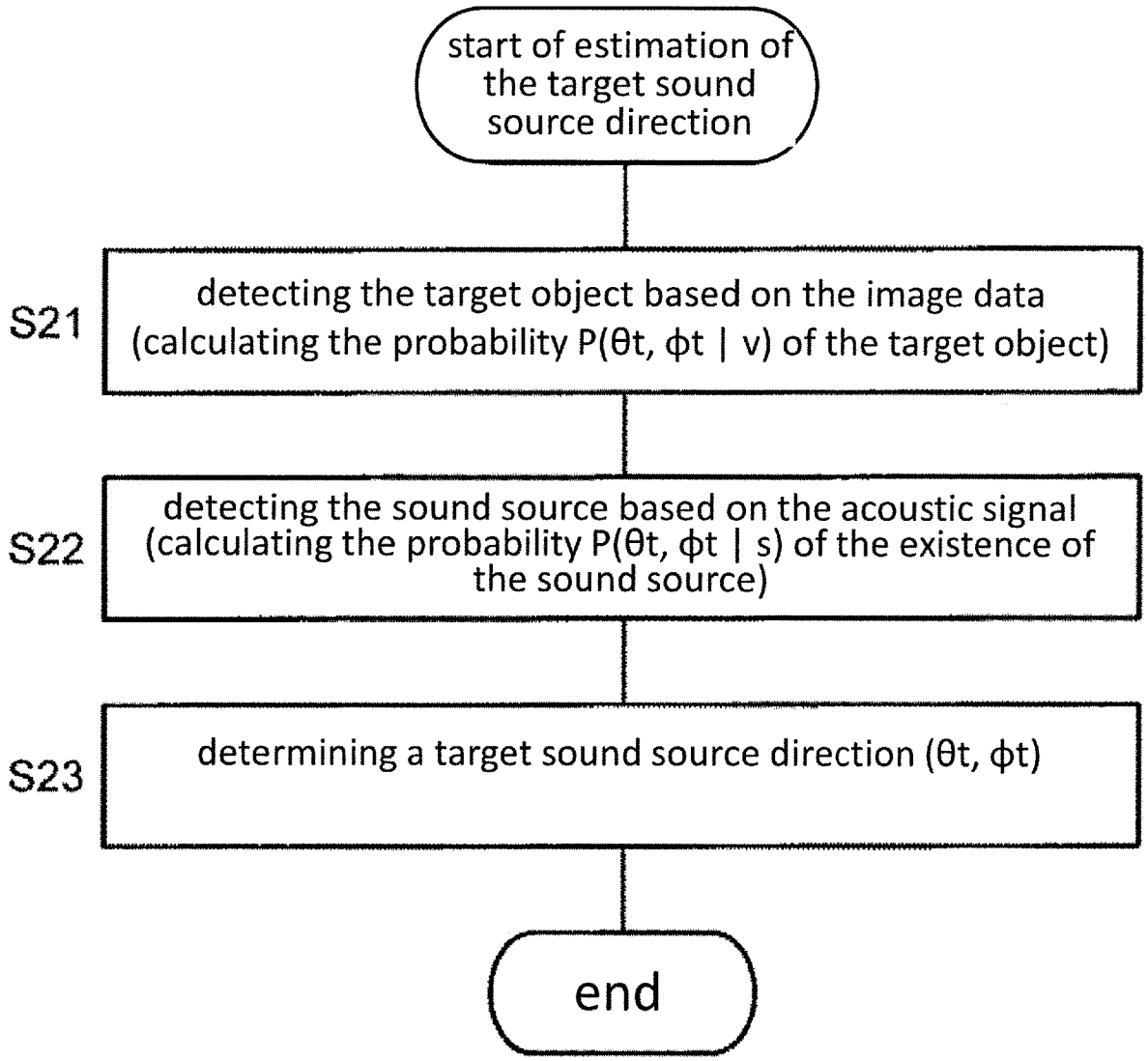
FIG. 12 is a flowchart showing an overall operation of estimating a target sound source direction according to the first to third embodiments.

The estimation of the target sound source direction will be described with reference to FIGS. 12 to 15. FIG. 12 shows the details of the estimation of the target sound source direction (S2). In FIG. 12, the order of detection of a target object in Step S21 and detection of a sound source in Step S22 may be reversed.

The target object detection operation 31*a* detects the target object based on the image data v generated by the camera 10 (S21). Specifically, the target object detection operation 31*a* calculates the probability $P(\theta_t, \varphi_t|v)$ that the image in the determination region $r(\theta_t, \varphi_t)$ is the target object in the image data v. The method of detecting a target object is freely selectable. As an example, the detection of the target object is performed by determining whether or not each determination region $r(\theta_t, \varphi_t)$ matches the feature of a face that is a target object (see "Rapid Object Detection using a Boosted Cascade of Simple Features" ACCEPTED CONFERENCE ON COMPUTER VISION AND PATTERN RECOGNITION 2001).

The sound source detection operation 31*b* detects the sound source based on the acoustic signal s output from the microphone array 20 (S22). Specifically, the sound source detection operation 31*b* calculates the probability $P(\theta_t, \varphi_t|s)$ that the sound source is present in the direction specified by the horizontal angle $\theta_t$ and the vertical angle $\varphi_t$. The method of detecting a sound source is freely selectable. For example, the sound source can be detected using a CSP (Cross-Power Spectrum Phase Analysis) method or a MUSIC (Multiple Signal Classification) method.

The target sound source direction determination operation 31*c* determines a target sound source direction $(\theta_t, \varphi_t)$ based on the probability $P(\theta_t, \varphi_t|v)$ that the image is the target object calculated from the image data v and the probability $P(\theta_t, \varphi_t|s)$ that the image is the sound source calculated from the acoustic signal s (S23).

Figure 13:
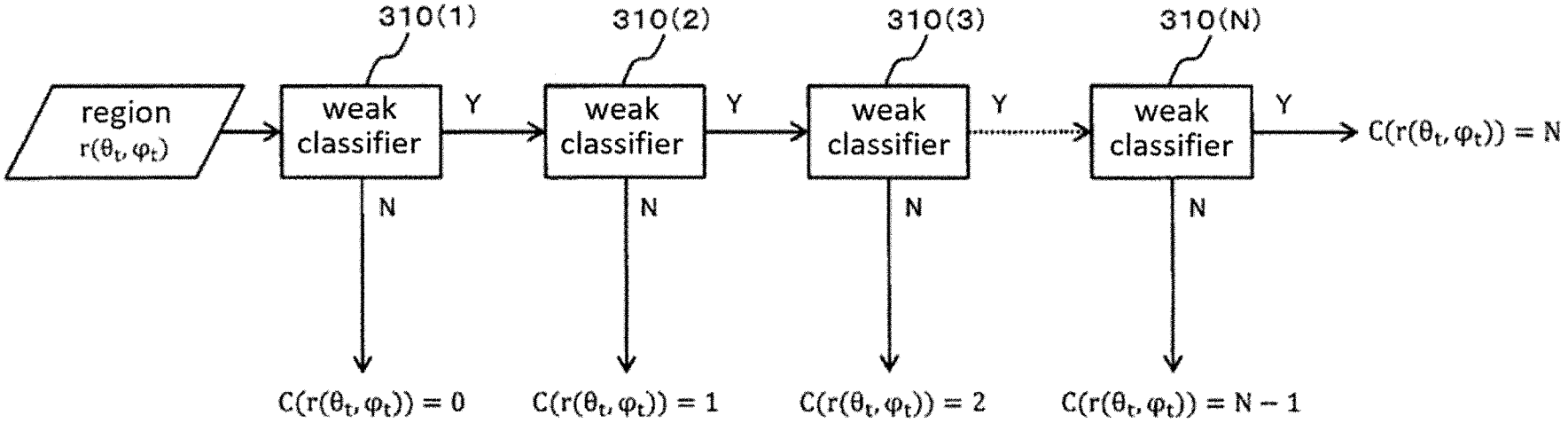
FIG. 13 is a diagram for explaining detection of a target object.

An example of the face specification method in Step S21 will be described. FIG. 13 shows an example of the face specification method. The target object detection operation 31*a* includes, for example, weak classifiers 310(1) to 310(N). When the weak classifiers 310(1) to 310(N) are not particularly distinguished, they are also referred to as N weak classifiers 310. The weak classifiers 310(1) to 310(N) each have information indicating facial features. The information indicating the facial features differs in each of the N weak classifiers 310. The target object detection operation 31*a* calculates the number of times $C(r(\theta_t, \varphi_t))$ when the region $r(\theta_t, \varphi_t)$ is determined to be a face. Specifically, the target object detection operation 31*a* first determines by the first weak classifier 310(1) whether or not the region $r(\theta_t, \varphi_t)$ is a face. If the weak classifier 310(1) determines that the region $r(\theta_t, \varphi_t)$ is not a face, "$C(r(\theta_t, \varphi_t))=0$" is obtained. If the first weak classifier 310(1) determines that the region $r(\theta_t, \varphi_t)$ is a face, the second weak classifier 310(2) determines whether or not the region $r(\theta_t, \varphi_t)$ is a face by using the information of the facial features different from that used in the first weak classifier 310(1). If the second weak classifier 310(2) determines that the region $r(\theta_t, \varphi_t)$ is a face, the third weak classifier 310(3) determines whether or not the region $r(\theta_t, \varphi_t)$ is a face. As described above, for the image data v corresponding to one frame of a video or one still image, it is determined whether or not the region $r(\theta_t, \varphi_t)$ is a face using the N weak classifiers 310 for each region $r(\theta_t, \varphi_t)$. For example, if all the N weak classifiers 310 determine that the region $r(\theta_t, \varphi_t)$ is a face, the number of times the region $r(\theta_t, \varphi_t)$ is determined to be a face is "$C(r(\theta_t, \varphi_t))=N$".

The size of the region $r(\theta_t, \varphi_t)$ at the time of detecting a face may be constant or variable. For example, the size of the region $r(\theta_t, \varphi_t)$ at the time of detecting a face may change for each image data v for one frame of a video or one still image.

When the target object detection operation 31*a* determines whether or not the region $r(\theta_t, \varphi_t)$ is a face for all the regions $r(\theta_t, \varphi_t)$ in the image data v, the target object detection operation 31*a* calculates the probability $P(\theta_t, \varphi_t|v)$ that the image at the position specified by the horizontal angle $\theta_t$ and the vertical angle $\varphi_t$ in the image data v is a face by the following expression (1).

$$P(\theta_t, \varphi_t \mid v) = \frac{1}{N} C(r(\theta_t, \varphi_t)) \tag{1}$$

Figure 14:
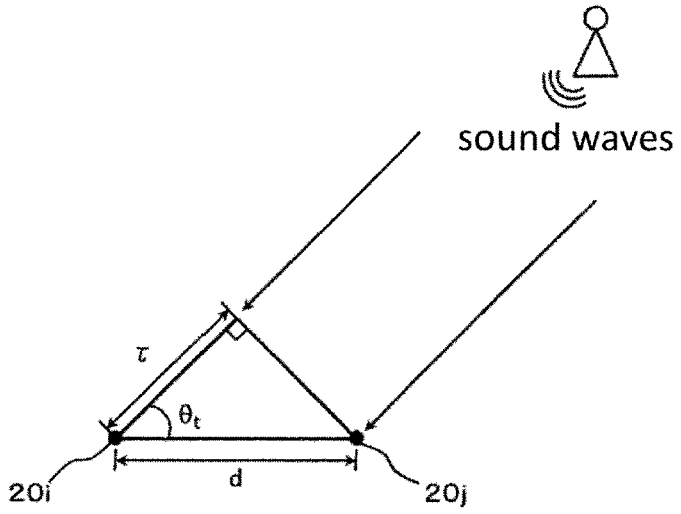
FIG. 14 is a diagram for explaining detection of a sound source.

The CSP method, which is an example of the method of detecting a sound source in Step S22, will be described. FIG. 14 schematically shows a state in which sound waves arrive at the microphones 20*i* and 20*j* of the microphone array 20. Depending on the distance d between the microphones 20*i* and 20*j*, there is a time difference $\tau$ when the sound waves arrive at the microphones 20*i* and 20*j*.

The sound source detection operation 31*b* calculates a probability $P(\theta_t|s)$ that the sound source is present at the horizontal angle $\theta_t$ by the following expression (2) using the CSP coefficient.

$$P(\theta_t|s)=CSP(\tau) \tag{2}$$

Here, the CSP coefficient can be obtained by Expression (3) below (see IEICE Transactions D-II Vol. J83-D-II No. 8 pp. 1713-1721, "Localization of Multiple Sound Sources Based on CSP Analysis with a Microphone Array"). In Expression (3), n represents time, Si(n) represents an acoustic signal received by the microphone 20*i*, and Sj(n) represents an acoustic signal received by the microphone 20*j*. In Expression (3), DFT represents a discrete Fourier transform. Further, * indicates a conjugate complex number.

$$CSP_{i,j}(\tau) = DFT^{-1}\left[\frac{DFT[s_i(n)]DFT[s_j(n)]*}{|DFT[s_i(n)]||DFT[S_j(n)]|}\right] \tag{3}$$

The time difference $\tau$ can be expressed by Expression (4) below using a sound velocity c, the distance d between the microphones 20*i* and 20*j*, and a sampling frequency $F_s$.

$$\tau = \frac{dF_s}{c}\cos(\theta_t) \tag{4}$$

Therefore, as shown in Expression (5) below, by converting the CSP coefficient of Expression (2) from the time axis to the direction axis by Expression (5), the probability $P(\theta_t|s)$ that the sound source is present at the horizontal angle $\theta_t$ can be calculated.

$$P(\theta_t \mid s) = CSP\left(\frac{dF_s}{c}\cos(\theta_t)\right) \tag{5}$$

A probability $P(\varphi_t|s)$ that the sound source is present at the vertical angle $\varphi_t$ can be calculated from the CSP coefficient and the time difference $\tau$, similarly to the probability $P(\theta_t|s)$ at the horizontal angle $\theta_t$. Further, the probability $P(\theta_t, \varphi_t|s)$ can be calculated based on the probability $P(\theta_t|s)$ and the probability $P(\varphi_t|s)$.

Figure 15:
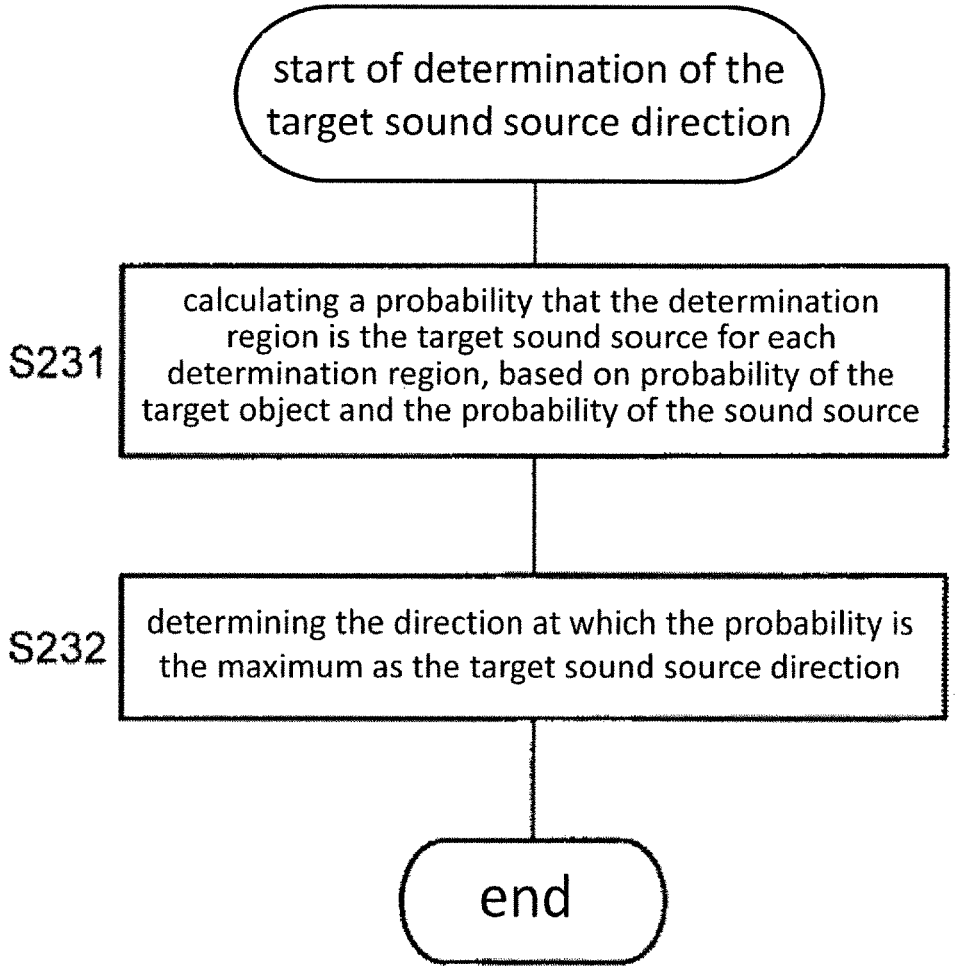
FIG. 15 is a flowchart showing determination of the target sound source direction according to the first to third embodiments.

FIG. 15 shows the details of the determination of the target sound source direction (S23). The target sound source direction determination operation 31*c* calculates a probability $P(\theta_t, \varphi_t)$ that the determination region $r(\theta_t, \varphi_t)$ is the target sound source for each determination region $r(\theta_t, \varphi_t)$ (S231). For example, the target sound source direction determination operation 31*c* uses the probability $P(\theta_t, \varphi_t|v)$ of the target object and its weight Wv, and the probability $P(\theta_t, \varphi_t|s)$ of the sound source and its weight Ws to calculate the probability $P(\theta_t, \varphi_t)$ that a person that is the target sound source is present by Expression (6) below.

$$P(\theta_t,\varphi_t)=WvP(\theta_t,\varphi_t|v)+WsP(\varphi_t,\varphi_t|s) \tag{6}$$

Then, the target sound source direction determination operation 31*c* determines the horizontal angle $\theta_t$ and the vertical angle $\varphi_t$ at which the probability $P(\theta_t, \varphi_t)$ is the maximum as the target sound source direction by Expression (7) below (S232).

$$\hat{\theta}_t, \hat{\varphi}_t=\mathrm{argmax}(P(\theta_t,\varphi_t)) \tag{7}$$

The weight Wv for the probability $P(\theta_t, \varphi_t|v)$ of the target object shown in Expression (6) may be determined based on an image accuracy CMv indicating a certainty that the target object is included in the image data v, for example. Specifically, for example, the target sound source direction determination operation 31*c* sets the image accuracy CMv based on the image data v. For example, the target sound source direction determination operation 31*c* compares an average brightness Yave of the image data v with a recommended brightness (Ymin_base to Ymax_base). The recommended brightness has a range from the minimum recommended brightness (Ymin_base) to the maximum recommended brightness (Ymax_base). Information indicating the recommended brightness is stored in the storage 40 in advance. If the average brightness Yave is lower than the minimum recommended brightness, the target sound source direction determination operation 31*c* sets the image accuracy CMv to "CMv=Yave/Ymin_base". If the average brightness Yave is higher than the maximum recommended brightness, the target sound source direction determination operation 31*c* sets the image accuracy CMv to "CMv=Ymax_base/Yave". If the average brightness Yave is within the range of the recommended brightness, the target sound source direction determination operation 31*c* sets the image accuracy CMv to "CMv=1". If the average brightness Yave is lower than the minimum recommended brightness Ymin_base or higher than the maximum recommended brightness Ymax_base, a face that is a target object may be erroneously detected. Therefore, when the average brightness Yave is within the range of the recommended brightness, the image accuracy CMv is set to the maximum value "1", and the image accuracy CMv is lowered as the average brightness Yave is higher or lower than the recommended brightness. The target sound source direction determination operation 31*c* determines the weight Wv according to the image accuracy CMv by, for example, a monotonically increasing function.

The weight Ws with respect to the probability $P(\theta_t, \varphi_t|s)$ of the sound source shown in Expression (6) may be determined based on, for example, an acoustic accuracy CMs indicating a certainty that a voice is included in the acoustic signal s. Specifically, the target sound source direction determination operation 31*c* calculates the acoustic accuracy CMs using a human voice GMM (Gausian Mixture Model) and a non-voice GMM. The voice GMM and the non-voice GMM are generated by learning in advance. Information indicating the voice GMM and the non-voice GMM is stored in the storage 40. The target sound source direction determination operation 31*c* first calculates a likelihood Lv based on the voice GMM in the acoustic signal s. Next, the target sound source direction determination operation 31*c* calculates the likelihood Ln based on the non-voice GMM in the acoustic signal s. Then, the target sound source direction determination operation 31*c* sets the acoustic accuracy CMs to "CMs=Lv/Ln". The target sound source direction determination operation 31*c* determines the weight Ws according to the acoustic accuracy CMs by, for example, a monotonically increasing function.

2.5 Beam Forming Processing

Figure 16:
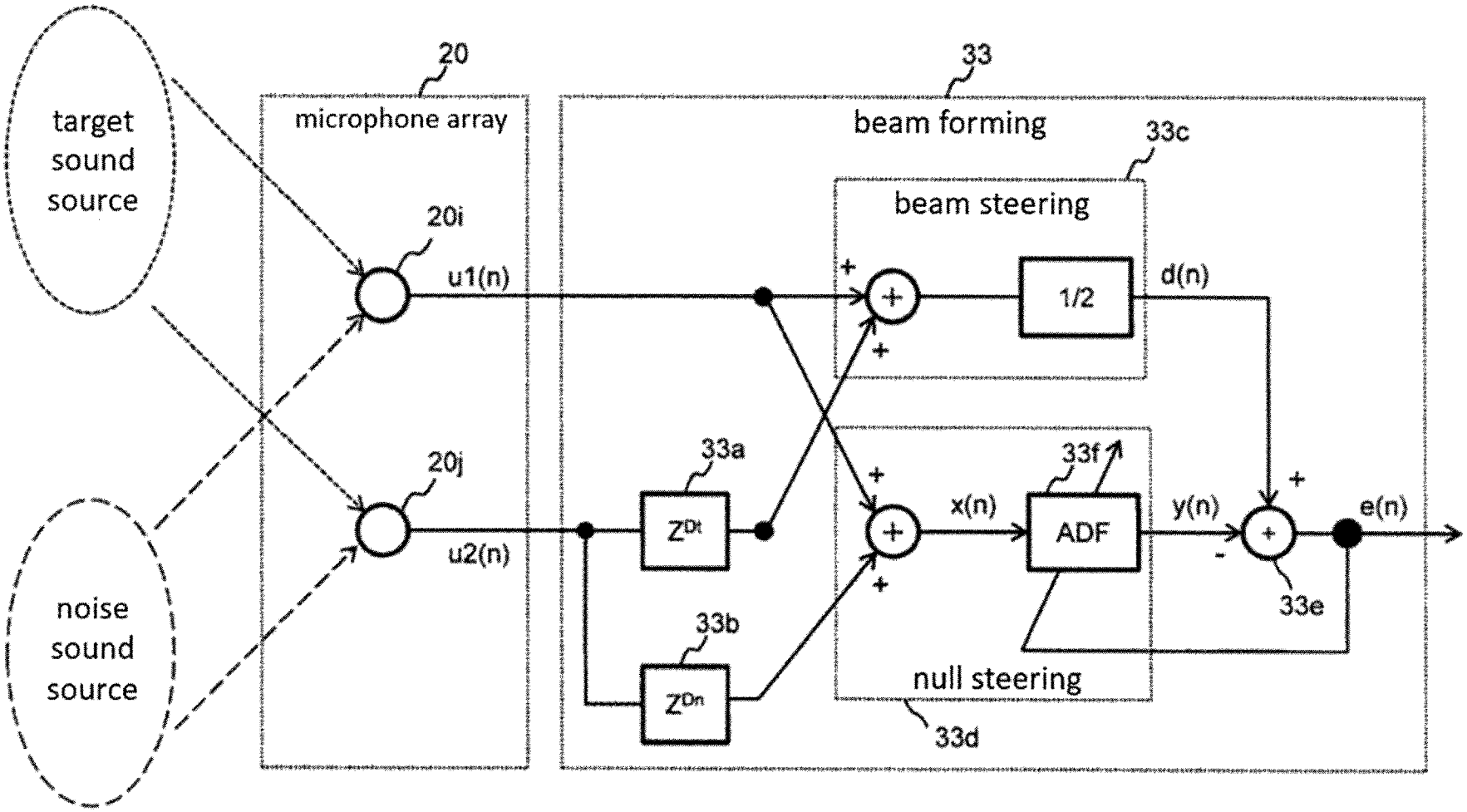
FIG. 16 is a diagram for explaining beam forming processing by a beam forming operation.

The beam forming processing (S3) by a beam forming operation 33 after the noise source direction $(\theta_n, \varphi_n)$ and the target sound source direction $(\theta_t, \varphi_t)$ are determined will be described. The method of beam forming processing is freely selectable. As an example, the beam forming operation 33 uses a generalized sidelobe canceller (GSC) (see Technical Report of IEICE, No. DSP2001-108, ICD2001-113, IE2001-92, pp. 61-68, October, 2001. "Adaptive Target Tracking Algorithm for Two-Channel Microphone Array Using Generalized Sidelobe Cancellers"). FIG. 16 shows a functional configuration of the beam forming operation 33 using the generalized sidelobe canceller (GSC).

The beam forming operation 33 includes an operation of delay elements 33*a* and 33*b*, a beam steering operation 33*c*, a null steering operation 33*d*, and an operation of a subtractor 33*e*.

The delay element 33*a* corrects an arrival time difference for a target sound based on a delay amount $Z^{Dt}$ according to the target sound source direction $(\theta_t, \varphi_t)$. Specifically, the delay element 33*a* corrects an arrival time difference between an input signal u2(*n*) input to the microphone 20*j* and an input signal u1(*n*) input to the microphone 20*i*.

The beam steering operation 33*c* generates an output signal d(n) based on the sum of the input signal u1(*n*) and the corrected input signal u2(*n*). At the input of the beam steering operation 33*c*, the phases of signal components arriving from the target sound source direction $(\theta_t, \varphi_t)$ match, and hence the signal components arriving from the target sound source direction $(\theta_t, \varphi_t)$ in the output signal d(n) are emphasized.

The delay element 33*b* corrects the arrival time difference regarding noise based on a delay amount $Z^{Dn}$ according to the noise source direction $(\theta_n, \varphi_n)$. Specifically, the delay element 33*b* corrects the arrival time difference between the input signal u2(*n*) input to the microphone 20*j* and the input signal u1(*n*) input to the microphone 20*i*.

The null steering operation 33*d* includes an adaptive filter (ADF) 33*f*. The null steering operation 33*d* set the sum of the input signal u1(*n*) and the corrected input signal u2(*n*) as an input signal x(n) of the adaptive filter 33*f*, and multiplies the input signal x(n) by the coefficient of the adaptive filter 33*f* to generate an output signal y(n). The coefficient of the adaptive filter 33*f* is updated so that the mean square error between the output signal d(n) of the beam steering operation 33*c* and the output signal y(n) of the null steering operation 33*d*, that is, the root mean square of the output signal e(n) of the subtractor 33*e*, is minimized.

The subtractor 33*e* subtracts the output signal y(n) of the null steering operation 33*d* from the output signal d(n) of the beam steering operation 33*c* to generate the output signal e(n). At the input of the null steering operation 33*d*, the phases of the signal components arriving from the noise source direction ($\theta_n$, $\varphi_n$) match, and hence the signal components arriving from the noise source direction ($\theta_n$, $\varphi_n$) in the output signal e(n) output by the subtractor 33*e* are suppressed.

The beam forming operation 33 outputs the output signal e(n) of the subtractor 33*e*. The output signal e(n) of the beam forming operation 33 is a signal in which the target sound is emphasized and the noise is suppressed.

The present embodiment shows an example of executing the processing of emphasizing the target sound and suppressing the noise by using the beam steering operation 33*c* and the null steering operation 33*d*. However, the processing is not limited to this, and any processing may be employed as long as the target sound be emphasized and the noise be suppressed.

3. Effects and Supplements

The sound collection device 1 according to the present embodiment includes the input device, the storage 40, and the control circuit 30. The input device in the sound collection device 1 including the camera 10 and the microphone array 20 is the control circuit 30. The input device inputs (receives) the acoustic signal output from the microphone array 20 and the image data generated by the camera 10. The storage 40 stores the non-target object data 41*a* indicating the image feature amount of the non-target object that is the noise source and the noise data 41*b* indicating the acoustic feature amount of the noise output from the noise source. The control circuit 30 performs the first collation (S113) for collating the image data with the non-target object data 41*a*, and the second collation (S123) for collating the acoustic signal with the noise data 41*b*, thereby specifying the direction of the noise source (S133). The control circuit 30 performs the signal processing on the acoustic signal so as to suppress the sound arriving from the specified direction of the noise source (S3).

In this way, since the image data obtained from the camera 10 is collated with the non-target object data 41*a*, and the acoustic signal obtained from the microphone array 20 is collated with the noise data 41*b*, the direction of the noise source can be accurately specified. As a result, the noise can be accurately suppressed, so that the accuracy of collecting the target sound is improved.

Second Embodiment

The present embodiment differs from the first embodiment in determining whether or not there is a noise source in the direction of the determination region r($\theta_n$, $\varphi_n$). In the first embodiment, the non-target object detection operation 32*a* compares the similarity P($\theta_n$, $\varphi_n$|v) with the predetermined value to determine whether or not the image in the determination region r($\theta_n$, $\varphi_n$) is a non-target object. The noise detection operation 32*b* compares the similarity P($\theta_n$, $\varphi_n$|s) with the predetermined value to determine whether or not the sound arriving from the direction of the determination region r($\theta_n$, $\varphi_n$) is noise. The noise source direction determination operation 32*c* determines that there is a noise source in the direction of the determination region r($\theta_n$, $\varphi_n$) when the image is a non-target object and noise.

In the present embodiment, the non-target object detection operation 32*a* outputs the similarity P($\theta_n$, $\varphi_n$..V) with the target object. That is, Steps S114 to S116 shown in FIG. 8 are not executed. The noise detection operation 32*b* outputs the similarity P($\theta_n$, $\varphi_n$|s) with the noise. That is, Steps S124 to S126 shown in FIG. 9 are not executed. The noise source direction determination operation 32*c* determines whether or not there is a noise source in the direction of the determination region r($\theta_n$, $\varphi_n$) based on the similarity P($\theta_n$, $\varphi_n$|v) with the target object and the similarity P($\theta_n$, $\varphi_n$|s) with the noise.

Figure 17:
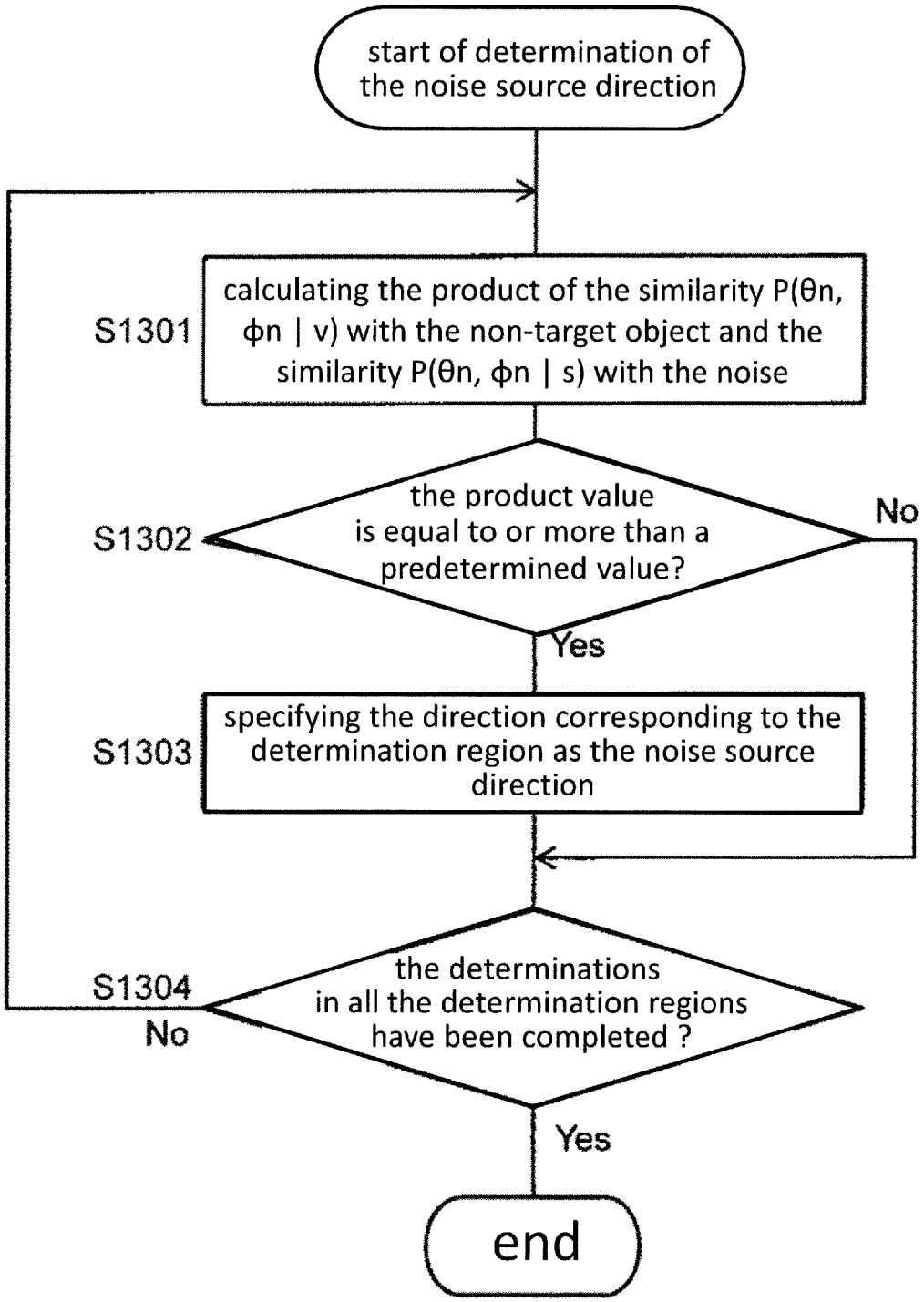
FIG. 17 is a flowchart showing determination of the noise source direction in the second embodiment.

FIG. 17 shows an example of determination of the noise source direction (S13) in the second embodiment. The noise source direction determination operation 32*c* calculates the product of the similarity P($\theta_n$, $\varphi_n$|v) with the non-target object and the similarity P($\theta_n$, $\varphi_n$|s) with the noise (S1301). The similarity P($\theta_n$, $\varphi_n$|v) with the non-target object and the similarity P($\theta_n$, $\varphi_n$|s) with the noise each correspond to the accuracy that a noise source is present in the determination region r($\theta_n$, $\varphi_n$). The noise source direction determination operation 32*c* determines whether or not the calculated product value is equal to or more than a predetermined value (S1302). If the product is equal to or more than the predetermined value, the noise source direction determination operation 32*c* determines that there is a noise source in the direction of the determination region ($\theta_n$, $\varphi_n$), and specifies the horizontal angle $\theta_{hd\ n}$ and the vertical angle $\varphi_n$ corresponding to the determination region ($\theta_n$, $\varphi_n$) as the noise source direction (S1303).

In FIG. 17, the product of the similarity P($\theta_n$, $\varphi_n$|v) with the non-target object and the similarity P($\theta_n$, $\varphi_n$|s) with the noise is calculated, but the present invention is not limited to this. For example, determination is made based on the sum of the similarity P($\theta_n$, $\varphi_n$|v) and the similarity P($\theta_n$, $\varphi_n$|s) with the noise (Expression (8)), the weighted product thereof (Expression (9), or the weighted sum thereof (Expression (10)).

$$P(\theta_n,\varphi_n|v)+P(\theta_n,\varphi_n|s) \tag{8}$$

$$P(\theta_n,\varphi_n|v)^{Wv}\times P(\theta_n,\varphi_n|s)^{Ws} \tag{9}$$

$$P(\theta_n,\varphi_n|v)^{Wv}+P(\theta_n,\varphi_n|s)^{Ws} \tag{10}$$

The noise source direction determination operation 32*c* determines whether or not the determinations in all the determination regions r($\theta_n$, $\varphi_n$) have been completed (S1304). If there is a determination region r($\theta_n$, $\varphi_n$) for which determination has not been made, the process returns to Step S1301. When the determinations for all the determination regions r($\theta_n$, $\varphi_n$) are completed, the process shown in FIG. 17 is terminated.

According to the present embodiment, as in the first embodiment, the noise source direction can be accurately specified.

Third Embodiment

The present embodiment differs from the first embodiment in data to be collated. In the first embodiment, the storage 40 stores the noise source data 41 indicating the feature amount of the noise source, and the noise source direction estimation operation 32 estimates the noise source direction using the noise source data 41. In the present embodiment, the storage 40 stores target sound source data indicating the feature amount of the target sound source, and the noise source direction estimation operation 32 estimates the noise source direction using the target sound source data.

Figure 18:
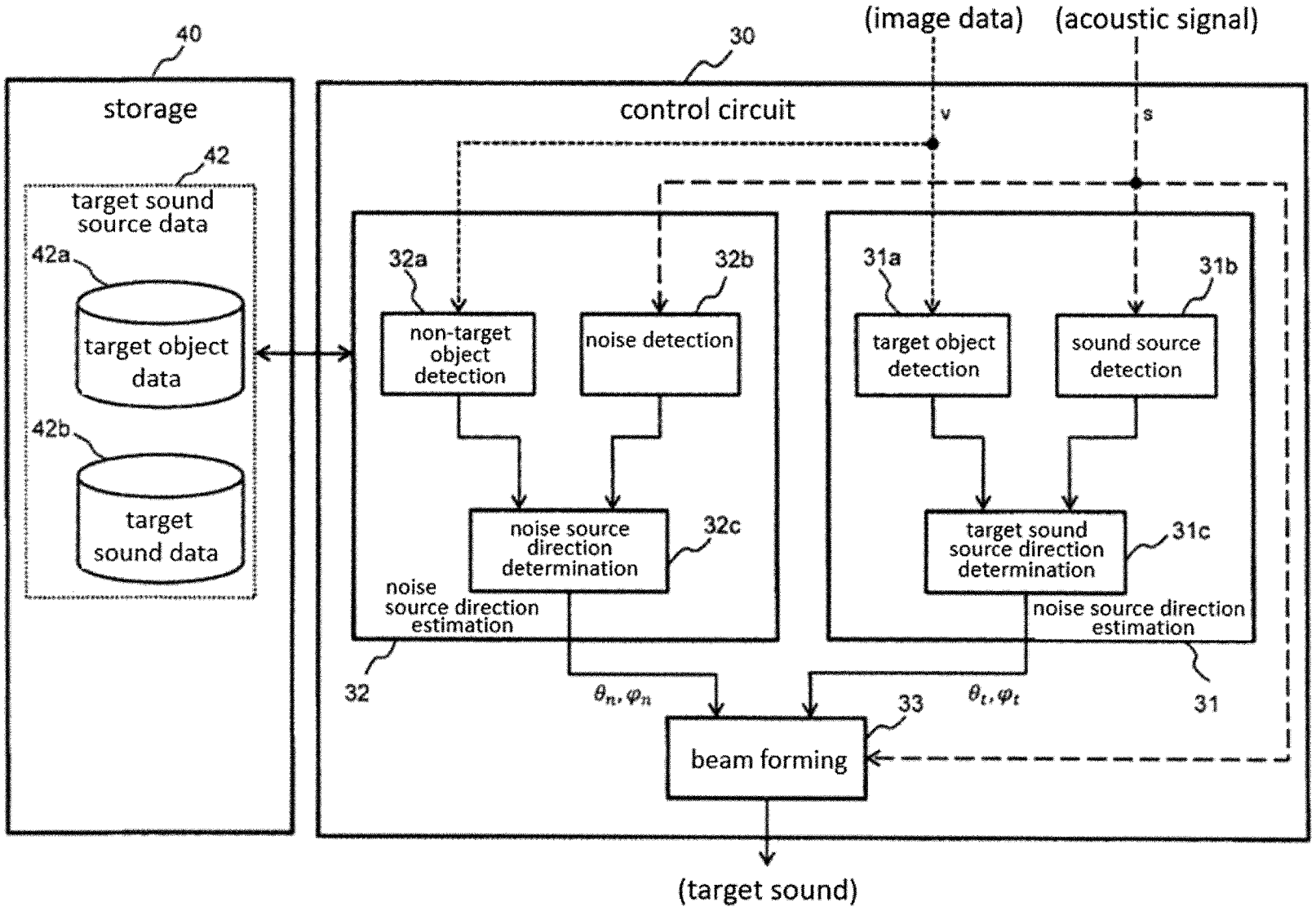
FIG. 18 is a block diagram showing an example of the functions of the control circuit and the data in the storage according to the third embodiment.

FIG. 18 shows functions of the control circuit 30 and the data stored in the storage 40 in the third embodiment. The storage 40 stores target sound source data 42. The target sound source data 42 includes target object data 42*a* and target sound data 42*b*. The target object data 42*a* includes an image feature amount of the target object that is a target sound source. The target object data 42*a* is, for example, a database including the image feature amount of the target object. The image feature amount is, for example, at least one of the wavelet feature amount, the Haar-like feature amount, the HOG feature amount, the EOH feature amount, the Edgelet feature amount, the Joint Haar-like feature amount, the Joint HOG feature amount, the sparse feature amount, the Shapelet feature amount, and the co-occurrence probability feature amount. The target sound data 42*b* includes an acoustic feature amount of the target sound output from the target sound source. The target sound data 42*b* is, for example, a database including the acoustic feature amount of the target sound. The acoustic feature amount of the target sound is, for example, at least one of MFCC and i-vector.

Figure 19:
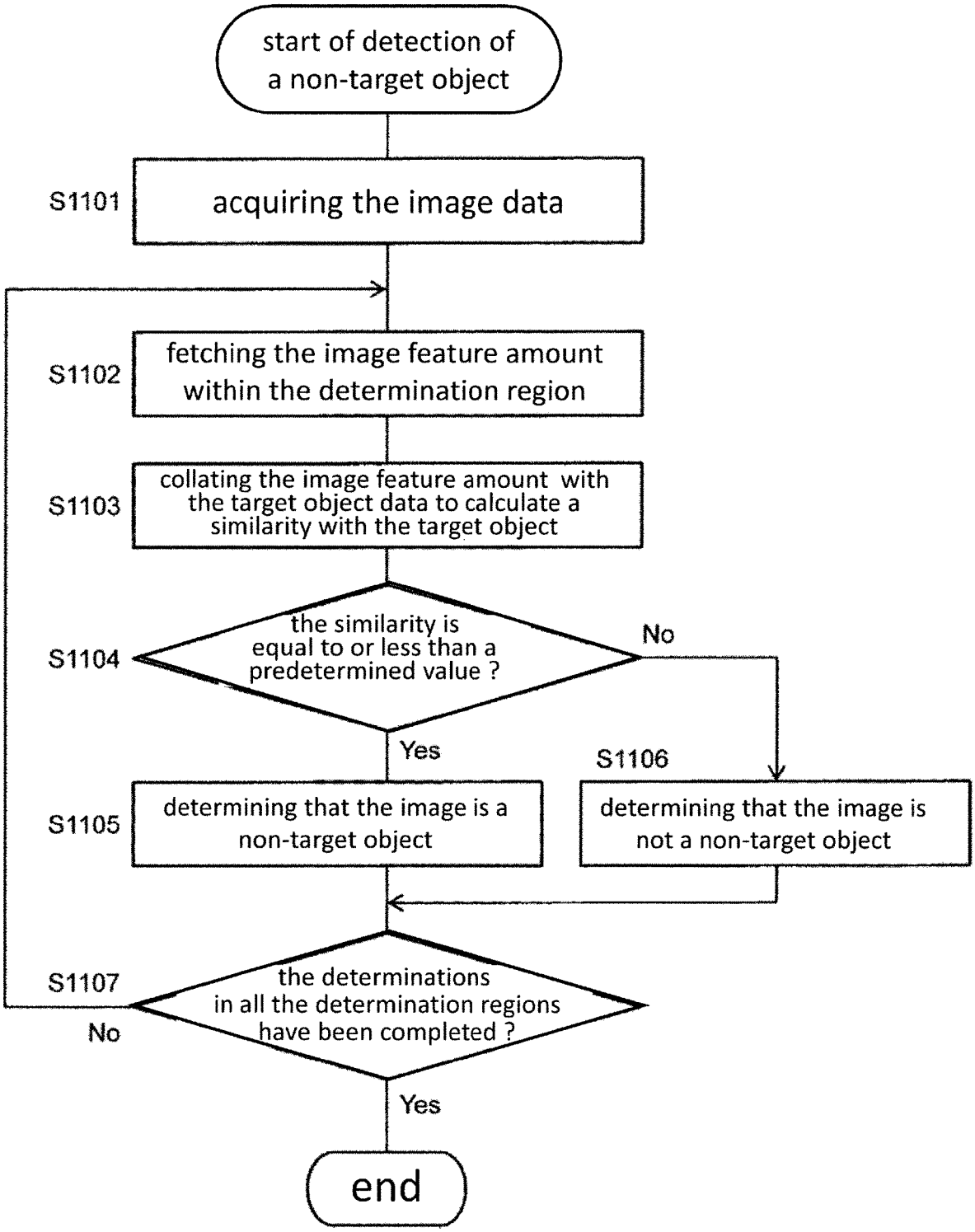
FIG. 19 is a flowchart showing detection of a non-target object according to the third embodiment.

FIG. 19 shows an example of detection of a non-target object (S11) in the present embodiment. Steps S1101, S1102, and S1107 in FIG. 19 are the same as Steps S111, S112, and S117 in FIG. 8, respectively. In the present embodiment, the non-target object detection operation 32*a* collates the fetched image feature amount with the target object data 42*a* to calculate the similarity with the target object (S1103). The non-target object detection operation 32*a* determines whether or not the similarity is equal to or less than a predetermined value (S1104). If the similarity is equal to or less than the predetermined value, the non-target object detection operation 32*a* determines that the image is not the target object, that is, a non-target object (S1105). If the similarity is larger than the predetermined value, the non-target object detection operation 32*a* determines that the image is the target object, that is, not a non-target object (S1106).

Figure 20:
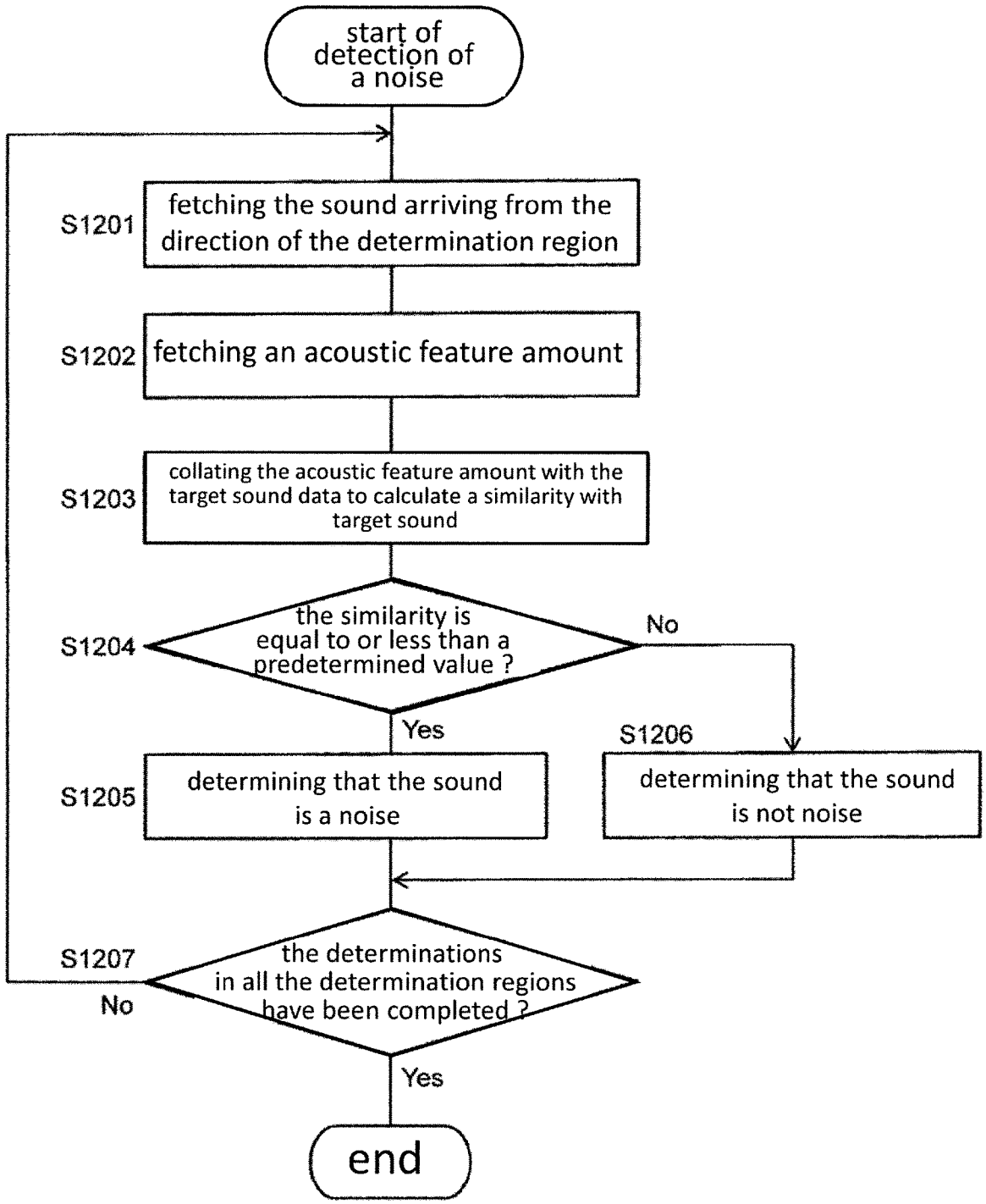
FIG. 20 is a flowchart showing detection of noise according to the third embodiment.

FIG. 20 shows an example of detection of noise (S12) in the present embodiment. Steps S1201, S1202, and S1207 in FIG. 20 are the same as Steps S121, S122, and S127 in FIG. 9, respectively. In the present embodiment, the noise detection operation 32*b* collates the fetched acoustic feature amount with the target sound data 42*b* to calculate the similarity with a target sound (S1203). The noise detection operation 32*b* determines whether the similarity is equal to or less than a predetermined value (S1204). If the similarity is equal to or less than the predetermined value, it is determined that the sound arriving from the direction of the determination region $r(\theta_n, \varphi_n)$ is not the target sound, that is, noise (S1205). If the similarity is larger than the predetermined value, it is determined that the sound arriving from the direction of the determination region $r(\theta_n, \varphi_n)$ is the target sound, that is, not noise (S1206).

According to the present embodiment, as in the first embodiment, the noise source direction can be accurately specified.

In the present embodiment, the target sound source data 42 may be used to specify the target sound source direction. For example, the target object detection operation 31*a* may detect a target object by collating the image data v with the target object data 42*a*. The sound source detection operation 31*b* may detect the target sound by collating the acoustic signal s with the target sound data 42*b*. In this case, the target sound source direction estimation operation 31 and the noise source direction estimation operation 32 may be integrated into one.

Other Embodiments

As described above, the first to third embodiments have been described as an example of the technology disclosed in the present application. However, the technology in the present disclosure is not limited to this, and is applicable to embodiments in which changes, replacements, additions, omissions, and the like are appropriately made. Further, each component described in the embodiments can be combined to make a new embodiment. Therefore, other embodiments are described below.

In the first embodiment, in Step S132 in FIG. 11, the noise source direction determination operation 32*c* determines whether or not the determination results in the determination region $r(\theta_n, \varphi_n)$ indicate that the image is a non-target object and noise. Furthermore, the noise source direction determination operation 32*c* may determine whether or not the noise source specified from the non-target object and the noise are the same. For example, it may be determined whether or not the non-target object specified from the image data is a door and the noise specified from the acoustic signal is a sound when the door is opened and closed. If an image of a door and a sound of the door are detected in the determination region $r(\theta_n, \varphi_n)$, it may be determined that there is a door that is a noise source in the direction of the determination region $r(\theta_n, \varphi_n)$.

In the first embodiment, in Step S132 of FIG. 11, if the non-target object and the noise are detected in the determination region $r(\theta_n, \varphi_n)$, the noise source direction determination operation 32*c* determines the horizontal angle $\theta_n$ and the vertical angle $\varphi_n$ corresponding to the determination region $r(\theta_n, \varphi_n)$ as the noise source direction. However, even if only one of the non-target object and the noise can be detected in the determination region $r(\theta_n, \varphi_n)$, the noise source direction determination operation 32*c* may determine the horizontal angle $\theta_n$ and the vertical angle $\varphi_n$ corresponding to the determination region $r(\theta_n, \varphi_n)$ in the noise source direction.

The non-target object detection operation 32*a* may specify the noise source direction based on the detection of the non-target object, and the noise detection operation 32*b* may specify the noise source direction based on the detection of the noise. In this case, the noise source direction determination operation 32*c* may determine whether or not to suppress the noise by the beam forming operation based on whether or not the noise source direction specified by the non-target object detection operation 32*a* and the noise source direction specified by the noise detection operation 32*b* match. The noise source direction determination operation 32*c* may suppress the noise by the beam forming operation 33 when the noise source direction can be specified by either one of the non-target object detection operation 32*a* and the noise detection operation 32*b*.

In the above embodiment, the sound collection device 1 includes both the non-target object detection operation 32*a* and the noise detection operation 32*b*, but may include only one of them. That is, the noise source direction may be specified only from the image data, or the noise source direction may be specified only from the acoustic signal. In this case, the noise source direction determination operation 32*c* may be omitted.

In the above embodiment, the collation by the template matching has been described. Instead of this, collation by machine learning may be performed. For example, the non-target object detection operation 32*a* may use PCA (Principal Component Analysis), neural network, linear discriminant analysis (LDA), support vector machine (SVM), AdaBoost, Real AdaBoost, or the like. In this case, the non-target object data 41*a* may be a model obtained by learning the image feature amount of the non-target object. Similarly, the target object data 42*a* may be a model obtained by learning the image feature amount of the target object. The non-target object detection operation 32*a* may perform all or part of the processing corresponding to Steps S111 to S117 in FIG. 8 using, for example, the model obtained by learning the image feature amount of the non-target object. The noise detection operation 32*b* may use, for example, PCA, neural network, linear discriminant analysis, support vector machine, AdaBoost, Real AdaBoost, or the like. In this case, the noise data 41*b* may be a model obtained by learning the acoustic feature amount of noise. Similarly, the target sound data 42*b* may be a model obtained by learning the acoustic feature amount of the target sound. The noise detection operation 32*b* may perform all or part of the processing corresponding to Steps S121 to S127 in FIG. 9 using, for example, the model obtained by learning the acoustic feature amount of noise.

A sound source separation technique may be used in the determination of the target sound or the noise. For example, the target sound source direction determination operation 31*c* may separate the acoustic signal into a voice and a non-voice by the sound source separation technique, and make determination of the target sound or the noise based on the power ratio between the voice and the non-voice. For example, blind sound source separation (BSS) may be used as the sound source separation technique.

In the above embodiment, an example in which the beam forming operation 33 includes the adaptive filter 33*f* has been described, but the beam forming operation 33 may have the configuration indicated by the noise detection operation 32*b* in FIG. 10. In this case, a blind spot can be formed by the output of the subtractor 322.

In the above embodiment, the example in which the microphone array 20 includes the two microphones 20*i* and 20*j* has been described, but the microphone array 20 may include two or more microphones.

The noise source direction is not limited to one direction and may be a plurality of directions. The emphasis in the target sound direction and the suppression in the noise source direction are not limited to the above embodiment, and can be performed by any method.

In the above embodiment, the case where the horizontal angle $\theta_n$ and the vertical angle $\varphi_n$ are determined as the noise source direction has been described, but when the noise source direction can be specified by at least any one of the horizontal angle $\theta_n$ and the vertical angle $\varphi_n$, at least any one of the horizontal angle $\theta_n$ and the vertical angle $\varphi_n$ may be determined. Similarly for the target sound source direction, at least any one of the horizontal angle $\theta_t$ and the vertical angle $\varphi_t$ may be determined.

The sound collection device 1 does not need to include one or both of the camera 10 and the microphone array 20. In this case, the sound collection device 1 is electrically connected to the external camera 10 or the external microphone array 20. For example, the sound collection device 1 may be an electronic device such as a smartphone including the camera 10, and electrically and mechanically connected to an external device including the microphone array 20. When the input/output interface circuit 50 inputs (receives) image data from the camera 10 externally attached to the sound collection device 1, the input/output interface circuit 50 corresponds to an input device for image data. When the input/output interface circuit 50 inputs (receives) an acoustic signal from the microphone array 20 externally attached to the sound collection device 1, the input/output interface circuit 50 corresponds to an input device for the acoustic signal.

In the above embodiment, an example of detecting a human face has been described, but in the case of collecting a human voice, the target object is not limited to a human face and may be any part that can be recognized as a person. For example, the target object may be a human body or a lip.

In the above embodiment, the human voice is collected as the target sound, but the target sound is not limited to the human voice. For example, the target sound may be a car sound or an animal bark.

(Summary of Embodiments)

(1) According to the present disclosure, there is provided a sound collection device that collects a sound while suppressing noise, the sound collection device including: a storage that stores first data indicating a feature amount of an image of an object that indicates a noise source or a target sound source; and a control circuit that specifies a direction of the noise source by performing a first collation of collating image data generated by a camera with the first data, and performs signal processing on an acoustic signal outputted from a microphone array so as to suppress a sound arriving from the specified direction of the noise source.

Since the direction of the noise source is specified by collating the image data with the first data indicating the feature amount of the image of the object that indicates the noise source or the target sound source, the direction of the noise source can be accurately specified. Since the noise arriving from the direction of the noise source that is accurately specified is suppressed, the accuracy of collecting the target sound is improved.

(2) In the sound collection device of the item (1), the storage may store second data indicating a feature amount of a sound output from the object, and the control circuit may specify the direction of the noise source by performing the first collation and a second collation of collating the acoustic signal with the second data.

Further, since the direction of the noise source is specified by collating the acoustic signal with the second data indicating the feature amount of the sound output from the object, the direction of the noise source can be accurately specified. Since the noise arriving from the direction of the noise source that is accurately specified is suppressed, the accuracy of collecting the target sound is improved.

(3) In the sound collection device of the item (1), the first data may indicate the feature amount of the image of the object that is the noise source, and the control circuit may perform the first collation, and when an object similar to the object is detected from the image data, the control circuit may specify a direction of the detected object as the direction of the noise source.

Thereby, a blind spot can be formed in advance before the noise source outputs the noise. Therefore, for example, a sudden sound generated from the noise source can be suppressed to collection the target sound.

(4) In the sound collection device of the item (1), the first data may indicate the feature amount of the image of the object that is the target sound source, and the control circuit may perform the first collation, and when an object not similar to the object is detected from the image data, the control circuit may specify a direction of the detected object as the direction of the noise source.

Thereby, a blind spot can be formed in advance before the noise source outputs the noise.

(5) In the sound collection device of the item (3) or (4), the control circuit may divide the image data into a plurality of determination regions in the first collation, collate an image in each determination region with the first data, and specify the direction of the noise source based on a position of the determination region including the detected object in the image data.

(6) In the sound collection device of the item (2), the second data may indicate a feature amount of noise output from the noise source, and the control circuit may perform the second collation, and when a sound similar to the noise is detected from the acoustic signal, the control circuit may specify a direction in which the detected sound arrives as the direction of the noise source.

By collating with the feature amount of the noise, the direction of the noise source can be accurately specified.

(7) In the sound collection device of the item (2), the second data may indicate a feature amount of a target sound output from the target sound source, and the control circuit may perform the second collation, and when a sound not similar to the target sound is detected from the acoustic signal, the control circuit may specify a direction in which the detected sound arrives as the direction of the noise source.

(8) In the sound collection device of (6) or (7), the control circuit may collection the acoustic signal with directivity directed to each of a plurality of determination directions in the second collation, and collate the collected acoustic signal with the second data to specify a determination direction in which the sound is detected as the direction of the noise source.

(9) In the sound collection device of the item (2), when the control circuit specified the direction of the noise source in any one of the first collation and the second collation, the control circuit may suppress the sound arriving from the direction of the noise source.

(10) In the sound collection device of the item (2), when the control circuit specified the direction of the noise source in both of the first collation and the second collation, the control circuit may suppress the sound arriving from the direction of the noise source.

(11) In the sound collection device of the item (2), a first accuracy that the noise source is present may be calculated by the first collation, and a second accuracy that the noise source is present may be calculated by the second collation, and when a calculation value calculated based on the first accuracy and the second accuracy is equal to or more than a predetermined threshold value, the control circuit may suppress the sound arriving from the direction of the noise source.

(12) In the sound collection device of the item (11), the calculation value may be any one of a product of the first accuracy and the second accuracy, a sum of the first accuracy and the second accuracy, a weighted product of the first accuracy and the second accuracy, and a weighted sum of the first accuracy and the second accuracy.

(13) In the sound collection device according to any one of the items (1) to (12), the control circuit may determine a target sound source direction in which the target sound source is present based on the image data and the acoustic signal, and perform signal processing on the acoustic signal so as to emphasize a sound arriving from the target sound source direction.

(14) The sound collection device of the item (1) may include at least one of the camera and the microphone array.

(15) In the sound collection device of the item (1), the image data may be generated by an external camera, and the acoustic signal may be outputted from an external microphone array.

(16) The sound collection device of the item (1) may further includes at least one of a first input device to receive the image data generated by an external camera; and a second input device to receive the acoustic signal outputted from an external microphone array.

(17) According to the present disclosure, there is provided a sound collection method of collecting a sound while suppressing noise by a control circuit, the sound collection method including: receiving image data generated by a camera; receiving an acoustic signal output from a microphone array; acquiring first data indicating a feature amount of an image of an object indicating a noise source or a target sound source; and specifying a direction of the noise source by performing a first collation of collating the image data with the first data, and performing signal processing on the acoustic signal so as to suppress a sound arriving from the specified direction of the noise source.

(18) According to the present disclosure, there is provided a non-transitory computer-readable storage medium storing a computer program to be executed by a control circuit of a sound collection device, the computer program causes the control circuit to execute: receiving image data generated by a camera; receiving an acoustic signal output from a microphone array; acquiring first data indicating a feature amount of an image of an object indicating a noise source or a target sound source; and specifying a direction of the noise source by performing a first collation of collating the image data with the first data, and performing signal processing on the acoustic signal so as to suppress a sound arriving from the specified direction of the noise source.

The sound collection device and the sound collection method according to all claims of the present disclosure are implemented by cooperation with hardware resources, for example, a processor, a memory, and a program.

INDUSTRIAL APPLICABILITY

The sound collection device of the present disclosure is useful, for example, as a device that collects a voice of a person who is talking.

What is claimed is:

1. A sound collection device that collects a sound while suppressing noise, the sound collection device comprising:

a storage that stores first data indicating a feature amount of an image of an object indicating a noise source or a target sound source, and second data including a feature amount of a sound output from the object; and a control circuit that specifies a direction of the noise source by performing a first collation of collating image data generated by a camera with the first data, and a second collation of collating the acoustic signal with the second data, and performs signal processing on an acoustic signal outputted from a microphone array according to the collation results so as to suppress a sound arriving from the specified direction of the noise source wherein the control circuit calculates, in the first collation, a first accuracy that the noise source is present, the control circuit calculates, in the second collation, a second accuracy that the noise source is present, and when a calculation value calculated based on the first accuracy and the second accuracy is equal to or more than a predetermined threshold value, the control circuit suppresses the sound arriving from the direction of the noise source.

2. The sound collection device according to claim 1, wherein the first data indicates the feature amount of the image of the object that is the noise source, and wherein in the first collation, when a similar object similar to the object is detected from the image data, the control circuit specifies a direction of the detected similar object as the direction of the noise source.

3. The sound collection device according to claim 2, wherein the control circuit divides the image data into a plurality of determination regions in the first collation, collates an image in each determination region with the first data, and specifies the direction of the noise source based on a position of the determination region including the detected similar object in the image data.

4. The sound collection device according to claim 1, wherein the first data indicates the feature amount of the image of the object that is the target sound source, and wherein in the first collation, and when a dissimilar object not similar to the object is detected from the image data, the control circuit specifies a direction of the detected dissimilar object as the direction of the noise source.

5. The sound collection device according to claim 4, wherein the control circuit divides the image data into a plurality of determination regions in the first collation, collates an image in each determination region with the first data, and specifies the direction of the noise source based on a position of the determination region including the detected dissimilar object in the image data.

6. The sound collection device according to claim 1, wherein the second data indicates a feature amount of noise output from the noise source, and wherein the control circuit performs the second collation, and when a sound similar to the noise is detected from the acoustic signal, the control circuit specifies a direction in which the detected sound arrives as the direction of the noise source.

7. The sound collection device according to claim 6, wherein the control circuit collects the acoustic signal with directivity directed to each of a plurality of determination directions in the second collation, and collates the collected acoustic signal with the second data to specify a determination direction in which the sound is detected as the direction of the noise source.

8. The sound collection device according to claim 1, wherein the second data indicates a feature amount of a target sound output from the target sound source, and wherein the control circuit performs the second collation, and when a sound not similar to the target sound is detected from the acoustic signal, the control circuit specifies a direction in which the detected sound arrives as the direction of the noise source.

9. The sound collection device according to claim 1, wherein the calculation value is any one of a product of the first accuracy and the second accuracy, a sum of the first accuracy and the second accuracy, a weighted product of the first accuracy and the second accuracy, and a weighted sum of the first accuracy and the second accuracy.

10. The sound collection device according to claim 1, wherein the control circuit determines a target sound source direction in which the target sound source is present, based on the image data and the acoustic signal, and performs signal processing on the acoustic signal so as to emphasize a sound arriving from the target sound source direction.

11. The sound collection device according to claim 1, comprising at least one of the camera and the microphone array.

12. The sound collection device according to claim 1, wherein the image data is generated by an external camera, and the acoustic signal is outputted from an external microphone array.

13. The sound collection device according to claim 1, further comprising at least one of a first input device to receive the image data generated by an external camera; and a second input device to receive the acoustic signal outputted from an external microphone array.

14. A sound collection method of collecting a sound while suppressing noise by a control circuit, the sound collection method comprising:

receiving image data generated by a camera;

receiving an acoustic signal output from a microphone array;

acquiring first data indicating a feature amount of an image of an object indicating a noise source or a target sound source;

acquiring second data indicating a feature amount of a sound output from the object;

specifying a direction of the noise source by performing a first collation of collating the image data with the first data, and a second collation of collating the acoustic signal with the second data, and performing signal processing on the acoustic signal according to the collation results so as to suppress a sound arriving from the specified direction of the noise source;

wherein the step of specifying the direction of the noise source and performing signal processing on the acoustic signal includes, calculating, in the first collation, a first accuracy that the noise source is present;

calculating, in the second collation, a second accuracy that the noise source is present; and suppressing, when a calculation value calculated based on the first accuracy and the second accuracy is equal to or more than a predetermined threshold value, the sound arriving from the direction of the noise source.

15. A non-transitory computer-readable storage medium storing a computer program to be executed by a control circuit of a sound collection device, the computer program causes the control circuit to execute:

receiving image data generated by a camera;

receiving an acoustic signal output from a microphone array;

acquiring first data indicating a feature amount of an image of an object indicating a noise source or a target sound source;

acquiring second data indicating a feature amount of a sound output from the object;

specifying a direction of the noise source by performing a first collation of collating the image data with the first data, and a second collation of collating the acoustic signal with the second data, and performing signal processing on the acoustic signal according to the collation results so as to suppress a sound arriving from the specified direction of the noise source;

wherein the step of specifying the direction of the noise source and performing signal processing on the acoustic signal includes, calculating, in the first collation, a first accuracy that the noise source is present;

calculating, in the second collation, a second accuracy that the noise source is present; and suppressing, when a calculation value calculated based on the first accuracy and the second accuracy is equal to or more than a predetermined threshold value, the sound arriving from the direction of the noise source.

* * * * *